US009803861B2

(12) United States Patent
Fu

(10) Patent No.: US 9,803,861 B2
(45) Date of Patent: Oct. 31, 2017

(54) HEATING SYSTEM AND METHOD OF OPERATING SAME

(71) Applicants: Reecon M & E Co. Ltd., Zhejiang (CN); Reecon North America LLC, Pittsburgh, PA (US)

(72) Inventor: Guohong Fu, Zhejiang (CN)

(73) Assignees: REECON M&E CO. LTD., Zhejiang (CN); REECON NORTH AMERICA LLC, Pittsburgh, PA (US)

( * ) Notice: Subject to any disclaimer, the term of this patent is extended or adjusted under 35 U.S.C. 154(b) by 320 days.

(21) Appl. No.: 14/686,729

(22) Filed: Apr. 14, 2015

(65) Prior Publication Data

US 2016/0305657 A1 Oct. 20, 2016

(51) Int. Cl.

| | |
|---|---|
| ***F23C 1/00*** | (2006.01) |
| ***F23N 1/00*** | (2006.01) |
| ***F23K 5/00*** | (2006.01) |
| ***F23N 5/10*** | (2006.01) |
| ***F23D 14/10*** | (2006.01) |

(52) U.S. Cl.

CPC ..... *F23N 1/005* (2013.01); *F23D 14/105* (2013.01); *F23K 5/007* (2013.01); *F23N 5/105* (2013.01); *F23K 2900/05001* (2013.01)

(58) Field of Classification Search

USPC ..... 431/12, 61

See application file for complete search history.

(56) References Cited

U.S. PATENT DOCUMENTS

| | | | | |
|---|---|---|---|---|
| 3,167,248 A * | 1/1965 | Douglas | F24C 3/128 236/15 A |
| 3,171,468 A * | 3/1965 | Sparrow | F23N 5/10 137/83 |
| 4,589,260 A * | 5/1986 | Krockow | F23D 11/005 60/737 |
| 5,020,988 A * | 6/1991 | Peterson | F23N 5/203 431/46 |

* cited by examiner

*Primary Examiner* — Avinash Savani
(74) *Attorney, Agent, or Firm* — Reed Smith LLP; Mark T. Vogelbacker

(57) ABSTRACT

A heating system can include a supply piping assembly configured to supply either a first fuel or a second fuel to at least one main burner, a first pilot burner and a second pilot burner. First and second electromagnetic valves can be operatively connected to an electrical power supply and at least one of the thermocouples. The first and second electromagnetic valves can be configured to permit and prevent the fuel from reaching at least one of the first pilot burner, the second pilot burner and the at least one main burner depending upon thermoelectric potential received from the at least one of the thermocouples.

24 Claims, 20 Drawing Sheets

HEATING SYSTEM AND METHOD OF OPERATING SAME

BACKGROUND

It is known to provide a heating apparatus that is capable of using more than one fuel to produce heat. These prior art devices, which may include vent-free gas heaters and vented gas heaters, must be connected to an alternating current (AC) power supply in order to function as intended.

Due to the large thermal value different between different types of fuels, these prior art devices generally have two different, separate or independent systems, one to utilize each fuel type. Prior art heating devices include a manually operable gas conversion valve, which allows or requires a user to switch between the two systems dependent upon the fuel being burned. If the gas conversion valve is incorrectly configured or adjusted, these prior art devices may not function as intended or in an efficient matter.

BRIEF SUMMARY

It would be desirable to overcome the above and other deficiencies of conventional heating devices. The system and method of the present disclosure provide such benefits.

In one embodiment, the present disclosure relates generally to a heating system capable of generating heat when supplied with either a first fuel or a second fuel. The system can include at least one main burner configured to generate heat. The at least one main burner can receive the fuel through at least one of a first inlet and a second inlet. A first pilot burner can include at least one thermocouple, and a second pilot burner can include at least one thermocouple. A supply piping assembly can be configured to supply either the first fuel or the second fuel to the at least one main burner, the first pilot burner and the second pilot burner. First and second electromagnetic valves can be operatively connected to an electrical power supply and at least one of the thermocouples. The first and second electromagnetic valves can be configured to permit and prevent the fuel from reaching at least one of the first pilot burner, the second pilot burner and the at least one main burner depending upon thermoelectric potential received from the at least one of the thermocouples.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings various illustrative embodiments. It should be understood, however, that the invention is not limited to the precise arrangements and instrumentalities shown. In the drawings.

DETAILED DESCRIPTION

Figure 1:
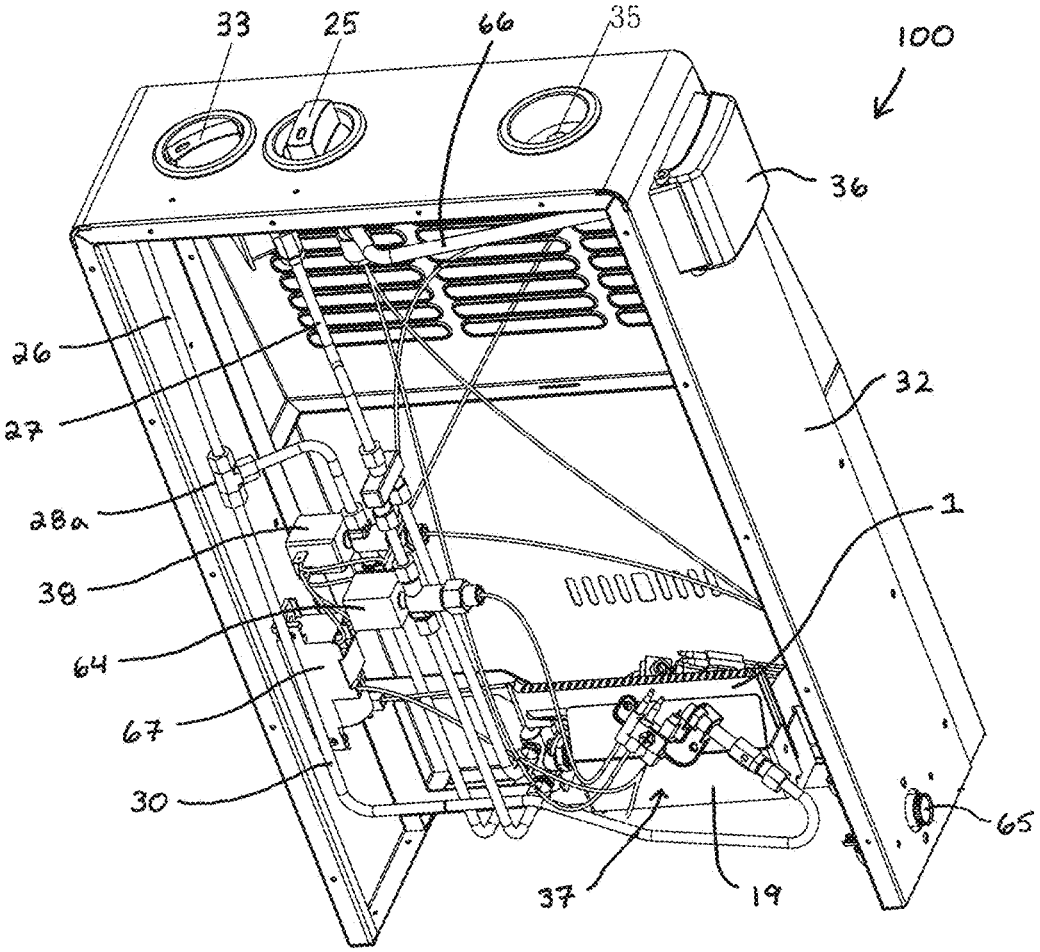
FIG. 1 is a rear perspective view of a heating system according to an embodiment of the present disclosure, wherein a rear cover is omitted for clarity.

Certain terminology is used in the following description for convenience only and is not limiting. Certain words used herein designate directions in the drawings to which reference is made. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like reference numerals indicate like elements throughout, FIGS. 1-13 show one embodiment of a heating system, generally designated 100, capable of automatically detecting when either a first fuel or a second fuel is supplied or received, and generating heat from the fuel. As described in detail below, the heating system 100 is able to detect or identify the fuel type or source based upon inputs received from one or more sensors, such as thermocouples.

The first fuel can be of a different type or form than the second fuel, such that a difference in thermal or heating values exists between the two fuels. In one embodiment, the second fuel has a higher thermal value than the first fuel. For example, the first fuel can be natural gas and the second fuel can be propane, such as liquid propane. But the present disclosure is not limited to these two fuels. For example, the fuels can include any combination of liquid butane, liquefied petroleum gas (LPG), liquid gasoline, hydrogen, propane, carbon monoxide (CO) and the like. In at least one embodiment, the difference in thermal values can be relatively large, such as approximately 83,000 Btu/ft$^3$. However, such a large different in thermo values between the two fuels is not required. Alternatively, the difference in thermo values between the two fuels can be greater than 83,000 Btu/ft$^3$ or even significantly less.

Figure 11:
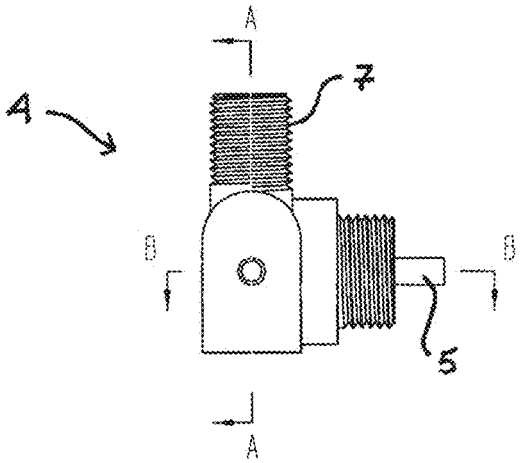
FIG. 11 is an elevation view of a nozzle holder of the heating system of FIG. 1.
Figure 12:
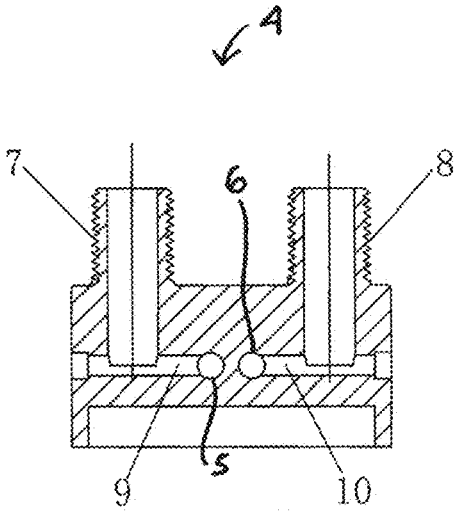
FIG. 12 is a cross-sectional elevation view of the nozzle holder of FIG. 11 taken along line "A-A" of FIG. 11.
Figure 13:
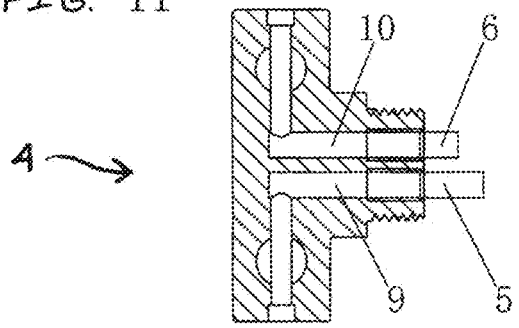
FIG. 13 is a cross-sectional elevation view of the nozzle holder of FIG. 11 taken along line "B-B" of FIG. 11.

The heating system 100 includes at least one main burner 1 configured to generate heat. A bracket 19 (FIGS. 1 and 4) can secure each main burner 1 to an outer housing 32 (FIG. 1) of the heating system 100. Each main burner 1 is configured to receive fuel through a first inlet 8 and a second inlet 7 spaced-apart therefrom. A nozzle holder 4 removably attaches both the first and second inlets 8, 7 to the main burner 1. As shown in FIGS. 11-12, a first nozzle 6 is fluidly connected to the first inlet 8 by a first channel 10 and a second nozzle 5 is fluidly connected to the second inlet 7 by a second channel 9. Both the first and second nozzles 6, 5 are positioned proximate to an air introduction opening 3 of a fluid passageway 2 within the main burner 1.

In operation, and as described in detail below, the first inlet 8 alone is sized, shaped and/or configured to provide the main burner 1 with a sufficient amount of fuel to generate a desired heat production when the second fuel is supplied. Thus, in at least one embodiment, the second inlet 7 does not provide, or is prevented from providing, any or an appreciable amount of fuel to the main burner 1 when the second fuel is burned. However, the second inlet 7 is configured to provide the main burner 1 with additional amount of fuel when the first fuel is burned, so that the heat output of the heating system 100 is able to reach the required or expected level.

Figure 2:
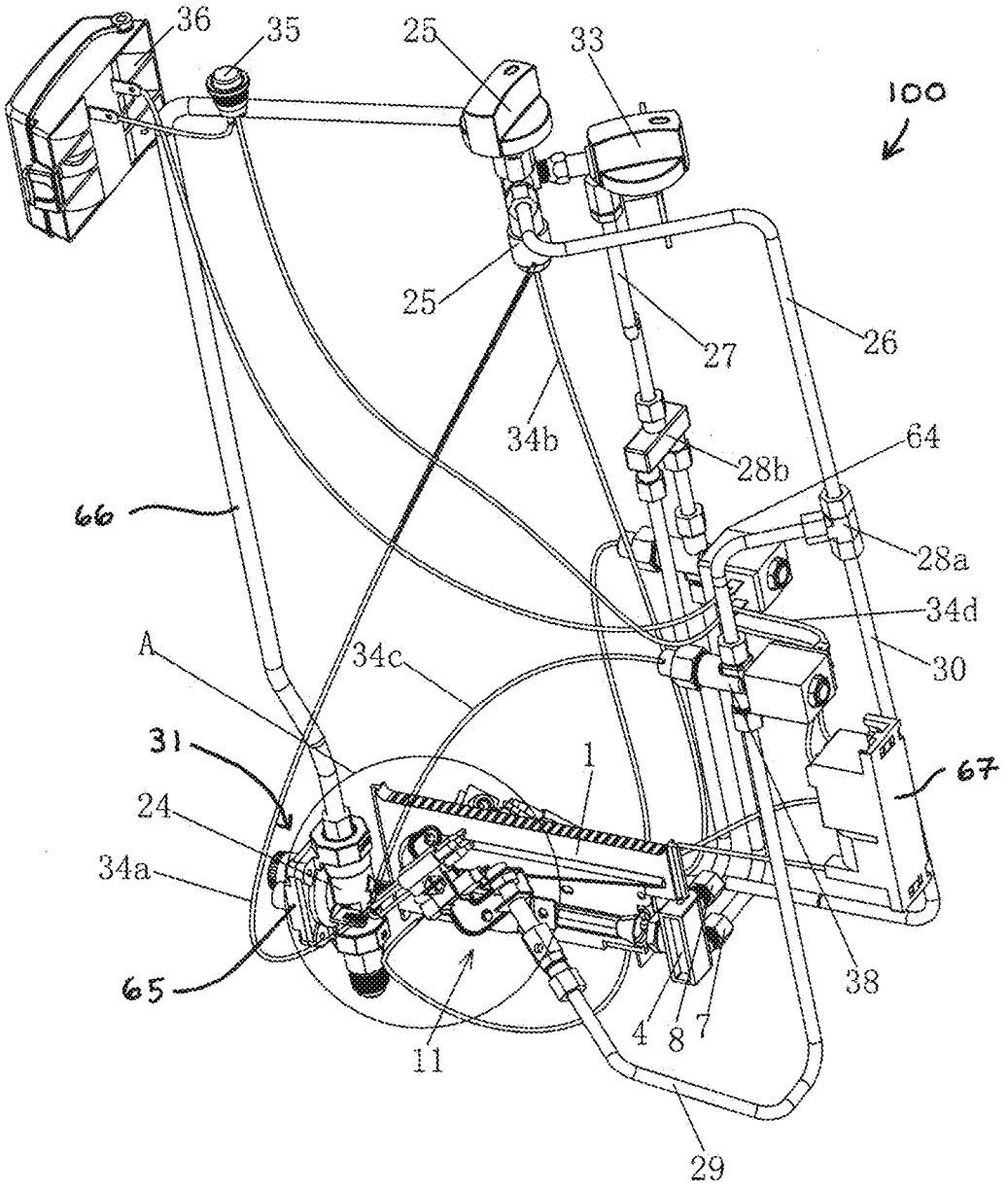
FIG. 2 is a front perspective view of portions of the heating system of FIG. 1.
Figure 3:
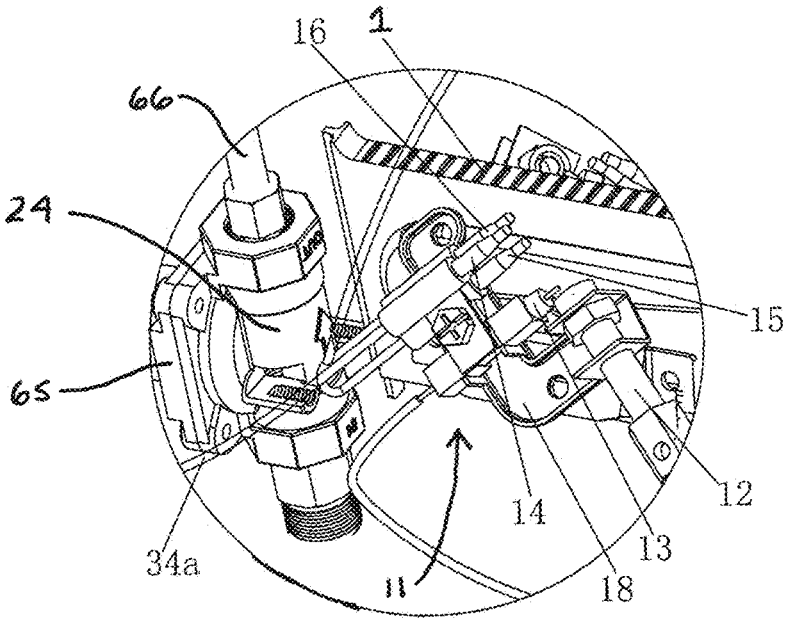
FIG. 3 is an enlarged perspective view of the portion of the heating system of FIG. 2 identified by area "A"

As shown in FIGS. 2 and 3, at least one first pilot burner, generally designated 11, can include a first burner 12, a first ignition electrode 13, and at least one thermocouple. More particularly, the first pilot burner 11 can include a first thermocouple 15, a second thermocouple 14 and a third or inverse thermocouple 16. A first burner bracket 18 may secure one or more components of the first pilot burner 11 to the main burner 1, the main burner bracket 19 and/or the outer housing 32.

At least a portion of the first and second thermocouples 15, 14 are positioned within a flame sensible area of the first burner 12 when the first pilot burner 11 is burning the first fuel (e.g., natural gas). The term "flame sensible area" is broadly defined herein as the range, reach or coverage of a flame. The third thermocouple 16 is located at least slightly further away from the first burner 12, as compared to the first and second thermocouples 15, 14. More particularly, the entire third thermocouple 16 is located at least slightly outside of the flame sensible area of the first burner 12 when the first burner 12 is burning the first fuel. However, at least a portion of the third thermocouple 16 is located within the flame sensible area of the first burner 12 when the first burner 12 is burning the second fuel (e.g., liquid propane).

Figure 4:
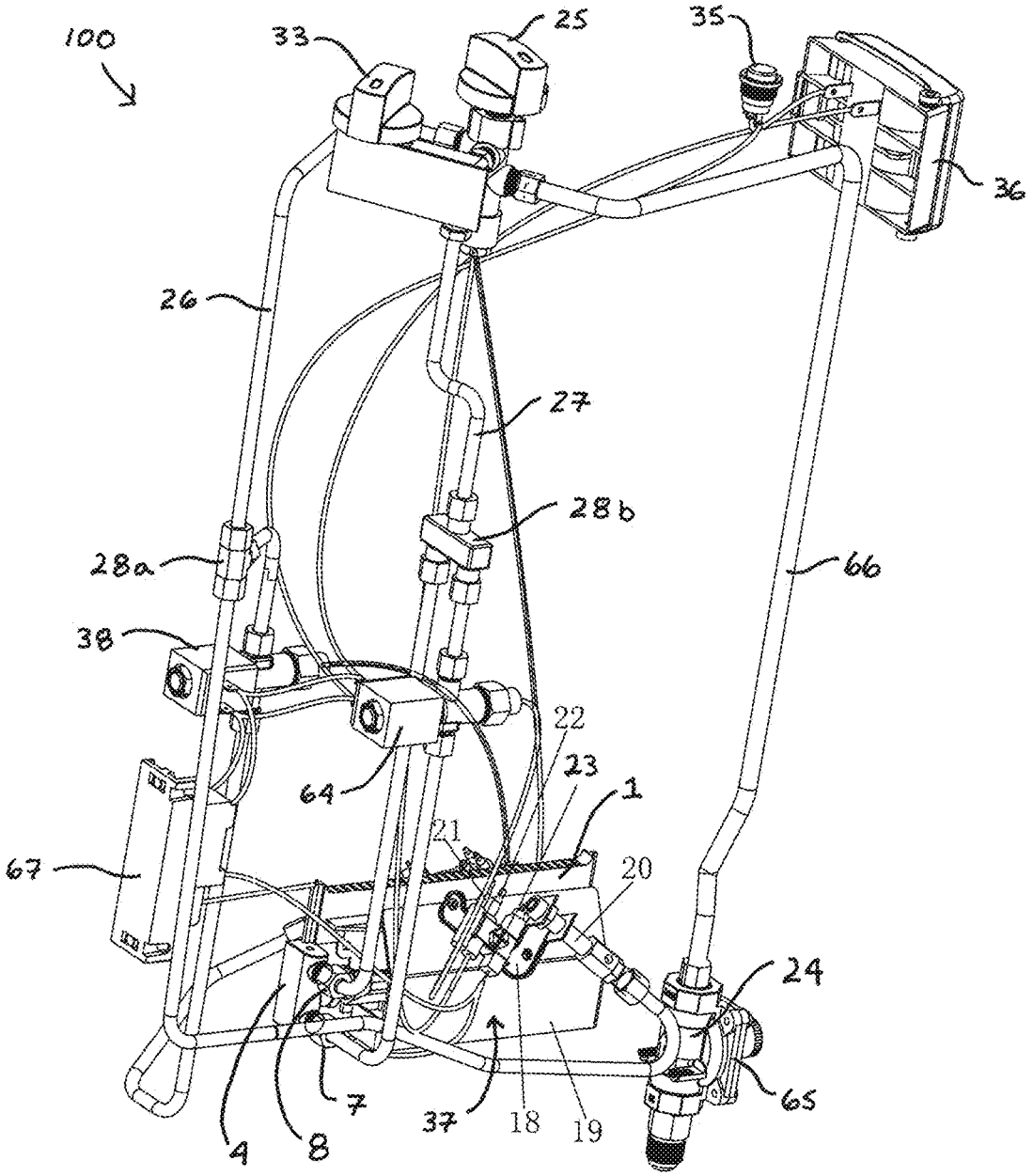
FIG. 4 is another rear perspective view of portions of the heating system of FIG. 1.
Figure 5:
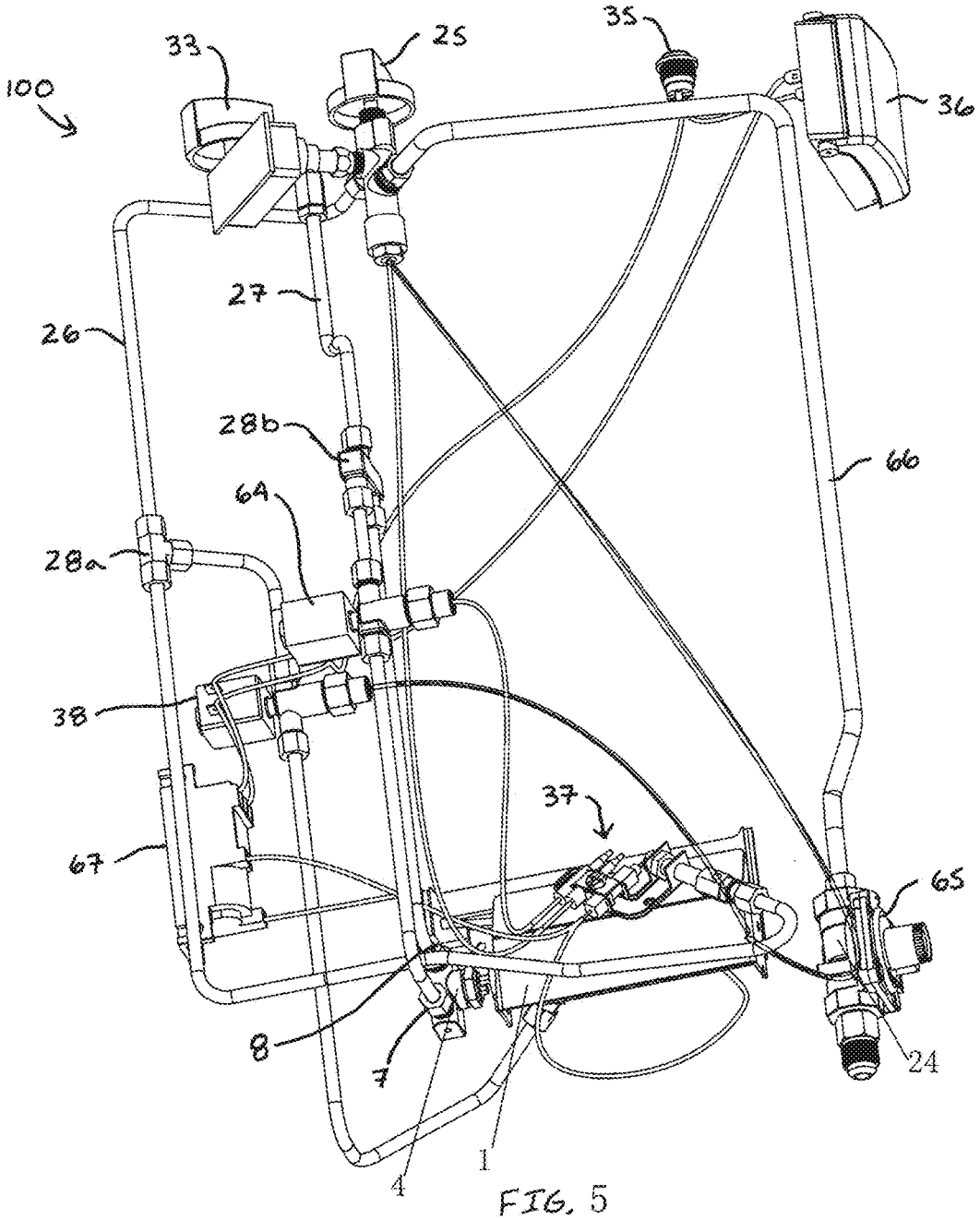
FIG. 5 is yet another rear perspective view of portions of the heating system of FIG. 1.

As shown in FIGS. 1, 4 and 5, at least one second pilot burner, generally designated 37, can include a second burner 20, a second ignition electrode 23, and at least one thermocouple. More particularly, as shown in FIG. 4, the second pilot burner 37 can include a fourth thermocouple 22 and a fifth thermocouple 21. At least a portion of both the fourth and fifth thermocouples 22, 21 can be located within the flame sensible area of the second burner 20 when the second burner 20 is burning the second fuel. A second burner bracket 18 may secure one or more components of the first pilot burner 11 to the main burner 1, the main burner bracket 19 and/or the outer housing 32.

A diameter of an orifice of the first burner 12 of the first pilot burner 11 can be larger than a diameter of an orifice of the second burner 20 of the second pilot burner 37. As a result of the smaller size of the second burner 20 and/or the lower thermal values of the first fuel, when the second burner 20 burns the first fuel, a flame produced by the second burner 20 cannot reach or affect either the fourth or fifth thermocouples 22, 21 of the second pilot burner 37. In other words, the fourth and fifth thermocouples 22, 21 are outside of the flame sensible area of the second burner 20 when the first fuel is burned. The first pilot burner 11 can be located on a first side of the main burner 1, while the second pilot burner 37 can be located on an opposite side of the main burner 1.

A supply piping assembly, generally designated 31, is configured to supply a either the first fuel or the second fuel to the main burner 1, the first pilot burner 11 and the second pilot burner. 37. The supply piping assembly 31 can include a fuel fitting 24, a fuel regulator 65 and a main gas supply pipe 66. The supply piping assembly 31 can be removably attachable to a source of fuel, such as a tank or fuel line, such that that heating system 100 can be portable.

User controls can be located at or near a top of the outer housing 32 of the heating system 100 to allow a user to initiate and/or control heating. For example, in one embodiment, a control valve 25 is operatively connected to at least one thermocouple of the first pilot burner 11 and to at least one thermocouple of the second pilot burner 37. In one embodiment, the control valve 25 is movable to and/or between an OFF position, a PILOT or IGNITION position, and an ON position or range. In the OFF position, fuel is prevented from reaching the main burner 1, the first pilot burner 11 and the second pilot burner 37. In the PILOT position, fuel is allowed to reach the first pilot burner 11 and the second pilot burner 37, but can be prevented from reaching the main burner 1 (such as by a position or configuration of a thermostat 33, described in more detail below). In the ON position, fuel can be permitted to flow to the main burner 1, the first pilot burner 11 and the second pilot burner 37. The control valve 25 can be biased to the OFF position, as described in detail below. A cover 67 enclosing a printed circuit board (PCB) may be operatively connected to the control valve 25 and other components of the heating system 100 via electrical wiring or cables.

According to one embodiment, only after the control valve 25 is depressed a predetermined distance in the PILOT position is fuel permitted to flow to the first and second pilot burners 11, 37. In addition, it can be desirable to depress the control valve 25 for a predetermined amount of time (e.g., 5-30 seconds) in the PILOT position even after the first and second burners 12, 20 are ignited. This allows for the thermocouples to generate sufficient thermoelectric potential for the system 100 to function as intended.

An ignition button 35, which alternatively can be a switch, can be operatively connected to an electrical power supply and the first and second ignition electrodes 13, 23 via electrical wiring or cables. The ignition button 35 can be operable by a user to cause the first ignition electrode 13 and the second ignition electrode 23 to produce a spark when the control valve 25 is in the PILOT position. In such a configuration, the control valve 25 is movable from the IGNITION position to the ON position after the heating system 100 is ignited, as described in detail below.

Figure 1A:
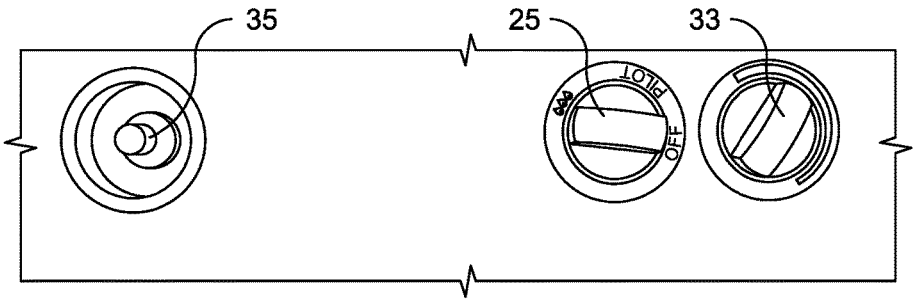
FIG. 1A is a top plan view of a control panel according to one embodiment of the heating system of FIG. 1.
Figure 1B:
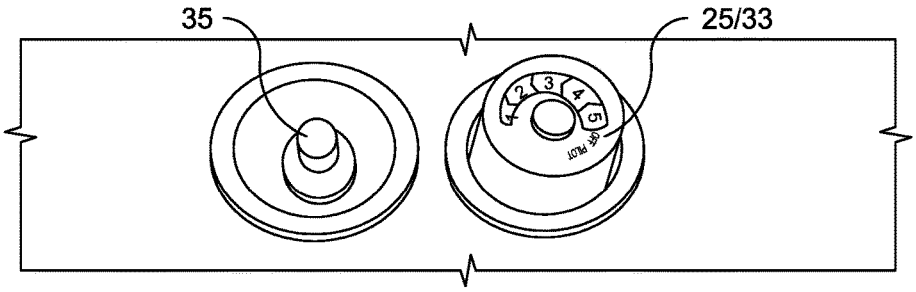
FIG. 1B is a top plan view of a control panel according to one embodiment of the heating system of FIG. 1.

A main burner pipe 27 operatively connects the control valve 25 to the first and second inlets 8, 7 of the main burner 1. The main burner pipe 27 can include a first T-joint 28*b*, which allows the main burner pipe 27 to be divided between the first inlet 8 and the second inlet 7. The thermostat 33 can be located in or attached to the main burner pipe 27. The thermostat 33 may be separate and spaced-apart from the control valve 25 (see FIG. 1A), or the system 100 can include a combined control valve and thermostat 25/33 (see FIG. 1B), such that the thermostat is built into the control valve. The thermostat 33 can allow the user to set the required or desired room temperature where the system 100 is placed or installed. For example, if the thermostat 33 is set to 20° C., and the room temperature reaches 20° C., the thermostat 33 will automatically shut off the fuel supply to the main burner 1. In this embodiment, the first and second burners 12, 20 can continue to burn normally. Then, when the room temperature lowers below the set point of 20° C., the thermostat 33 will open and permit the flow of fuel to the main burner 1 again. Thus, in one embodiment, the system 100 can be considered as identifying fuel source during an "ignition" or start-up period, but then function as a standard, single fuel heater thereafter.

A pilot burner pipe 26 operatively connects the control valve 25 to the first and second pilot burners 11, 37. The pilot burner pipe 26 can include a second T-joint 28*a*, which allows the pilot burner pipe 26 to be divided between the first pilot burner 11 and the second pilot burner 37. In particular, a first gas manifold 29 connects the second T-joint 28*a* to the first pilot burner 11, and a second gas manifold 30 connects the second T-joint 28*a* to the second pilot burner 37.

Electrical power can be supplied to the heating system 100 by the electrical power supply 36. In one embodiment, the electrical power supply 36 can be a battery pack. The battery pack can be removably attachable to the outer housing 32, and can be rechargeable. The battery pack 36 can include sufficient electrical potential to be usable for at least one season (e.g., winter) before needing to be replaced or recharged. Alternatively, the electrical power supply 36 can be a power cord configured to operatively connect to an electrical wall socket.

A first electromagnetic valve 38 is positioned in or attached to the pilot burner pipe 26 between the second T-joint 28*a* and the first pilot burner 11. The first electromagnetic valve 38 can be operatively connected to the electrical power supply 36, the ignition button 35 and at least one thermocouple of the first pilot burner 11, such as via electrical wiring or cable 34*c*, 34*d*. The first electromagnetic valve 38 is configured to permit or prevent fuel from reaching the first pilot burner 11 depending upon thermoelectric potential received or transferred from the at least one thermocouple of the first pilot burner 11. More particularly, the first electromagnetic valve 38 is operatively connected to both the second and third thermocouples 14, 16 of the first pilot burner 11.

Initially or prior to operation of the system 100, the first electromagnetic valve 38 can be biased to a closed position. During or by ignition of the system 100, the first electromagnetic valve 38 can be moved to an open position. In addition, a position (e.g., open or closed) of the first electromagnetic valve 38 can depend upon the existence and/or amount of thermoelectric potential received from at least one thermocouple of the first pilot burner 11. More particularly, in one embodiment, a position of the first electromagnetic valve 38 depends upon the thermoelectric potential received or transferred from the second and third thermocouples 14, 16 of the first pilot burner 11.

In operation, the first electromagnetic valve 38 can be maintained in an open position during operation of the heating system 100 when the first fuel is supplied by the supply piping assembly 31. The first electromagnetic valve 38 can be moved to the closed position during operation of the heating system 100 when the second fuel is supplied by the supply piping assembly 31. More particularly, by engagement of the ignition button 35, the first electromagnetic valve 38 can be closed. Following ignition, the first electromagnetic valve 38 can be opened or closed automatically according to thermoelectric potential received or transferred from the second and third thermocouples 14, 16. In other words, the first electromagnetic valve 38 is only powered by the battery pack 36 during an ignition period, which allows for a relatively long service or operational life of the battery pack 36.

The second and third thermocouples 14, 16 can be connected such that their individual thermoelectric potential will cancel each other out. For example, when the first pilot burner 11 is burning the first fuel (e.g., natural gas), at least a portion of the second thermocouple 14 can be within the flame sensible area, while the entire third thermocouple 16 can be at least slightly outside of the flame sensible area. In that situation, the second thermocouple 14 will generate thermoelectric potential, but the third thermocouple 16 will not. The combined thermoelectric potential transferred to or received by the first electromagnetic valve 38 will maintain the control valve 25 in the ON position after the ignition button 35 is released.

Similarly, when the first pilot burner 11 is burning the second fuel (e.g., liquid propane), the pilot flame of the first pilot burner 11 will be longer or greater at least in part because of the higher thermal value of the second fuel. In that situation, at least a portion of both the second and third thermocouples 14, 16 will be within the flame sensible area and, thereby, generate thermoelectric potential. However, the thermoelectric potential of the third or inverse thermocouple 16 can cancel that of the second thermocouple 14.

Thus, the combined thermoelectric potential received by or transferred to the first electromagnetic valve 38 will be dramatically reduced or even approach zero, such that first electromagnetic valve 38 cannot be maintained in the open position. In this situation, after the ignition button 35 is released, the first electromagnetic valve 38 will immediately shut off the fuel supply to the first burner 12.

Figure 6:
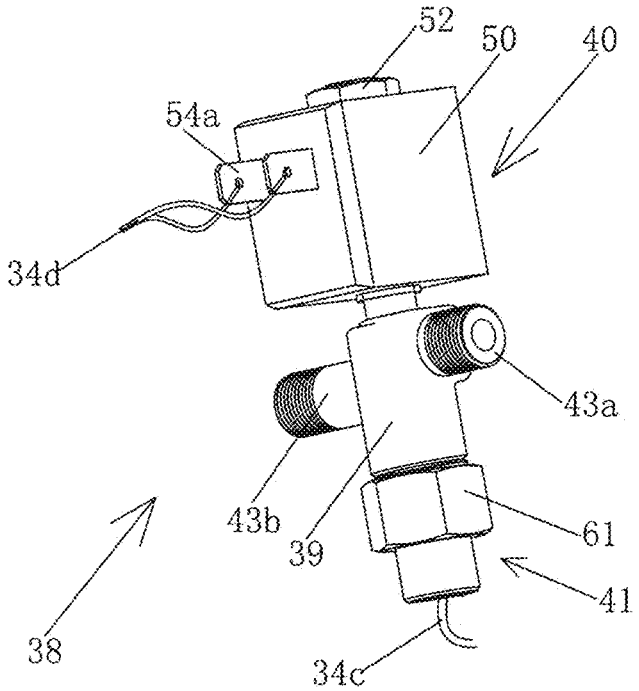
FIG. 6 is a perspective view of a valve of the heating system of FIG. 1.
Figure 7:
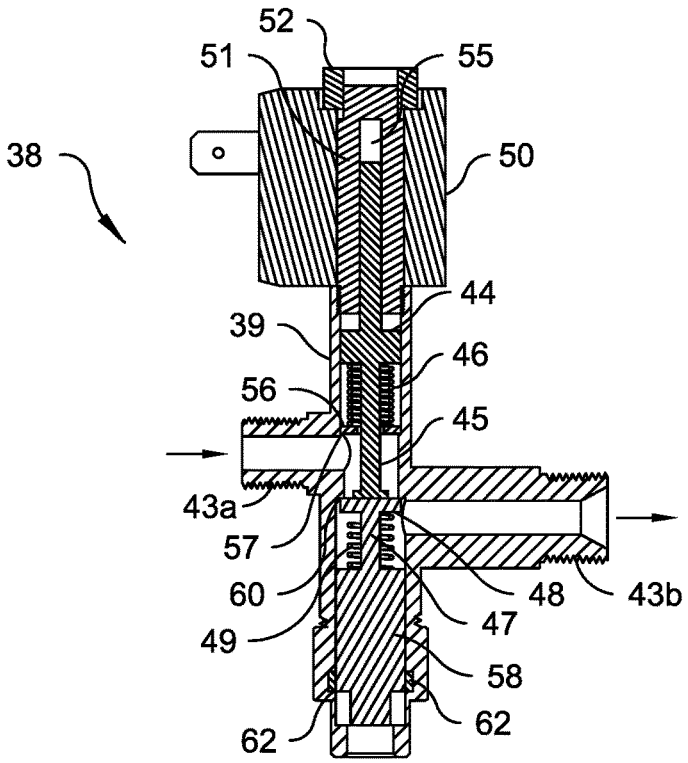
FIG. 7 is a cross-sectional elevation view of the valve of FIG. 6.
Figure 10:
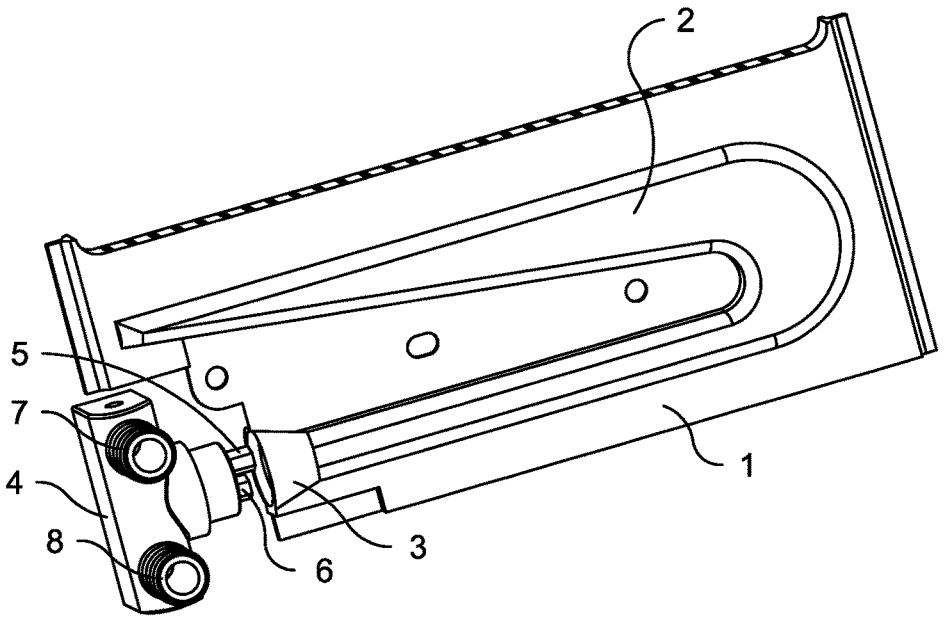
FIG. 10 is a perspective view of a burner of the heating system of FIG. 1.
Figure 8:
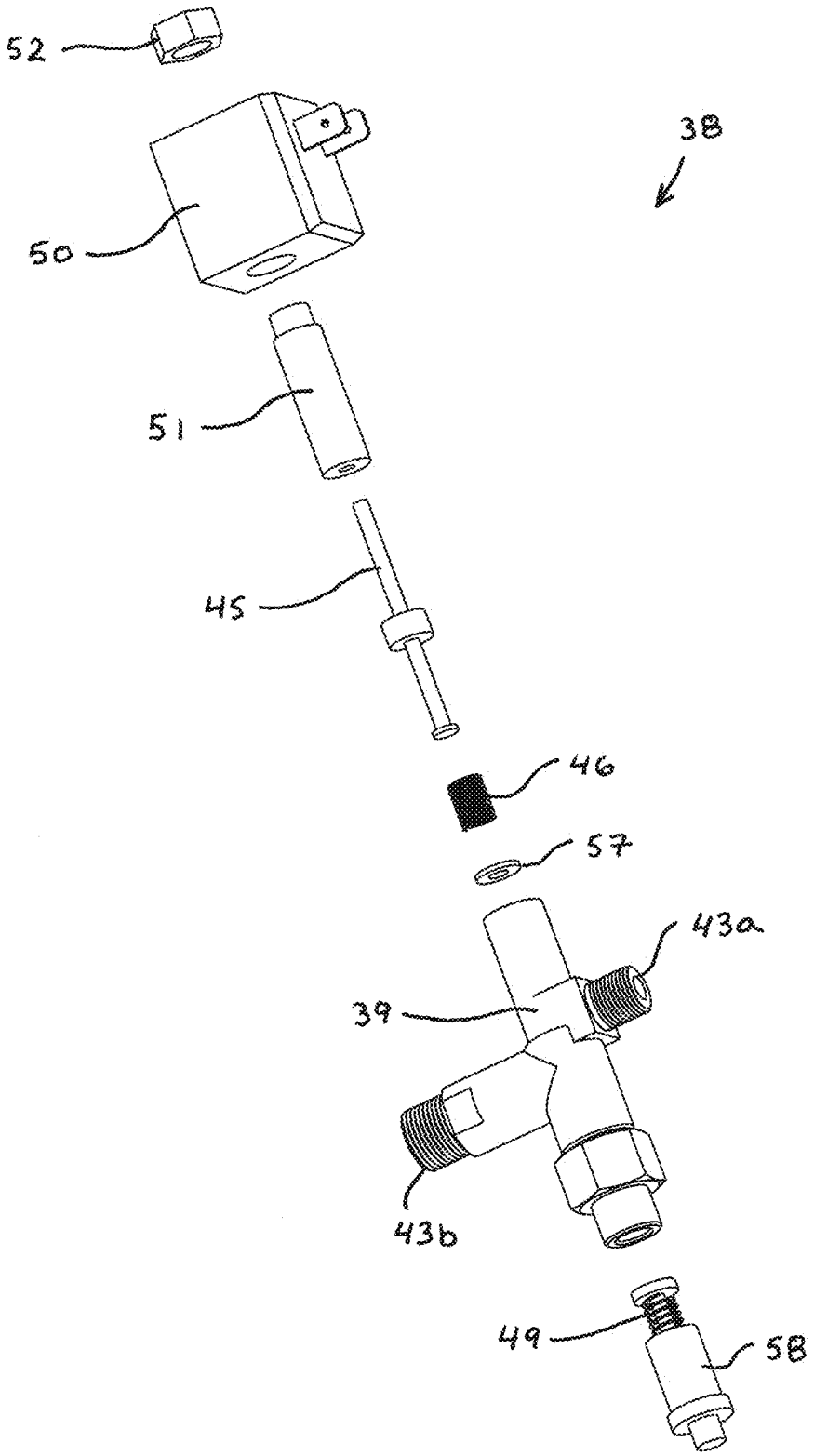
FIG. 8 is an exploded perspective view of the valve of FIG. 6.
Figure 9:
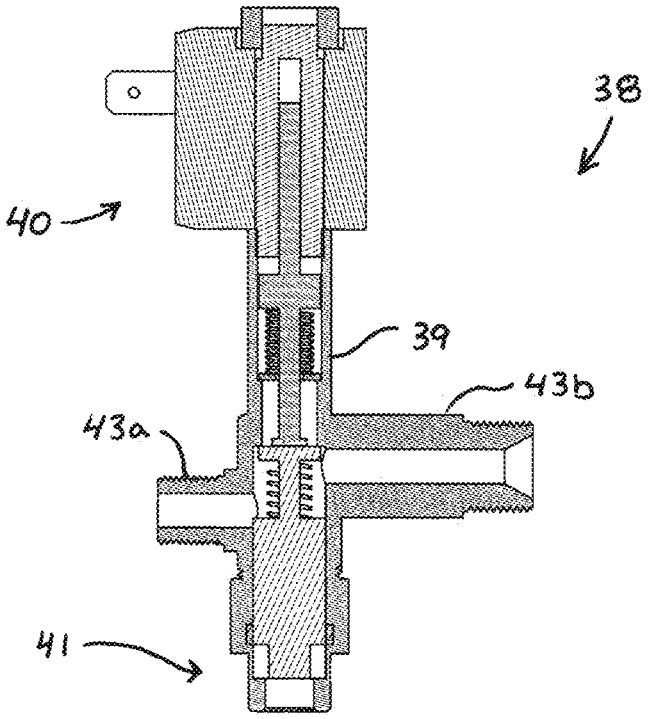
FIG. 9 is a cross-sectional elevation view of an alternative embodiment of the valve of FIG. 6.

FIGS. 6-8 show details of one embodiment of the first electromagnetic valve 38, and FIG. 9 shows details of an alternative embodiment of the first electromagnetic valve. The first electromagnetic valve 38 can include an upper portion 40, a mid-portion 39 and a lower portion 41. The upper portion 40 can include a housing 50, which can be formed of a polymeric material, a plug 54*a* attached to the electrical wiring or cable 34*d*, and a fixing screw 52. The mid-portion 39 can be in the form of a valve body formed of copper, for example. The mid-portion 39 can include a fuel inlet 43*a* and a fuel outlet 43*b*, and the flow of fuel through the mid-portion 39 is identified by arrows in FIG. 7. A nut 61 can removably attach the lower portion 41 to the mid-portion 39. Electrical wiring or cable 34*c* is operatively connected to the lower portion 41.

In one embodiment, as shown in FIG. 7, the flow of fuel through the first electromagnetic valve 38 is controlled through a piston and biasing member assembly. In particular, the first electromagnetic valve 38 can include an upper coil assembly 51, an upper cavity 55, an upper spring stage 44, an upper spring 46, an upper fluid channel 42, an upper core 45, a lower spring stage 48, a lower core 47, a lower spring 49, and a lower coil assembly 58, which can be formed of a polymeric material. At least a portion of the lower coil assembly 58 can engage interior threads 62 of the lower portion 41 of the first electromagnetic valve 38. An upper gasket 57 can sit on or be attached to an upper spring seat 56, and a lower gasket 60 can sit on or be attached to the lower spring stage 48.

A second electromagnetic valve 64 is positioned in or attached to the main burner pipe 27 between the first T-joint 28*b* and the second inlet 7 of the main burner 1. The second electromagnetic valve 64 can be operatively connected to the electrical power supply 36, the ignition button 35 and at least one thermocouple of the second pilot burner 37. More particularly, the second electromagnetic valve 64 is operatively connected to the fifth thermocouple 21 of the second pilot burner 37. The second electromagnetic valve 64 can include the same or similar components as the first electromagnetic valve 38 shown and described herein.

The second electromagnetic valve 64 can be biased to an open position. A position of the second electromagnetic valve 64 can depend upon the existence and/or amount of thermoelectric potential received from the at least one thermocouple (e.g., the fifth thermocouple 21) of the second pilot burner 37. The second electromagnetic valve 64 can be configured to permit or prevent fuel from reaching the second nozzle 7 depending upon thermoelectric potential received from the at least one thermocouple (e.g., the fifth thermocouple 21) of the second pilot burner 37. For example, the second electromagnetic valve 64 can initially be in an open position, and then moved to a closed position during or by ignition of the system 100.

More particularly, in one embodiment, by engagement of the ignition button 35, the second electromagnetic valve 64 is moved or reconfigured to a closed position. Following ignition, the second electromagnetic valve 64 will be maintained in an open position or closed position, automatically, according to the existence and/or amount of thermoelectric potential received or transferred from the fifth thermocouple 21. In other words, the second electromagnetic valve 64 is only powered by the battery pack 36 during an ignition period, which allows for the relatively long service life of the battery pack 36.

In operation, at ignition when burning the first fuel (e.g., natural gas), the first electromagnetic valve 38 can be moved to an open position such that both the first and second pilot burners 11, 37 are supplied with the first fuel. In this configuration, the first burner 12 of the first pilot burner 11 produces an average or normal size flame, while the second burner 20 of the second pilot burner 37 produces a flame having a smaller size than that of the first burner 12. After ignition, the first electromagnetic valve 38 remains open, the first burner 12 of the first pilot burner 11 maintains the average or normal size flame, and the second burner 20 of the second pilot burner 37 maintains the smaller size flame. In addition, after ignition, the second electromagnetic valve 64 returns to its initial open position, such that the first fuel can continue to flow to the main burner 1 through the first and second inlets 8, 7.

At ignition when burning the second fuel (e.g., liquid propane), the first electromagnetic valve 38 can moved to an open position such that both the first and second pilot burners 11, 37 are supplied with the second fuel. In this configuration, the first burner 12 of the first pilot burner 11 produces a flame having a relatively large size, while the second burner 20 of the second pilot burner 37 produces an average or normal size flame. After ignition, the first electromagnetic valve 38 returns to its initial closed position, the flame produced by the first burner 12 of the first pilot burner 11 is extinguished, and the second burner 20 of the second pilot burner 37 produces an average or normal size flame. In addition, after ignition, the second electromagnetic valve 64 is maintained in the closed position, such that second fuel flows to the main burner 1 only through the first inlet 8, and not through the second inlet 7.

When the second pilot burner 37 is burning the second fuel (e.g., liquid propane), at least a portion of the fifth thermocouple 21 is located within the flame sensible area of the second burner 20. As a result, the fifth thermocouple 21 will generate thermoelectric potential, which will cause the second electromagnetic valve 64 to be maintained in a closed position to prevent fuel from reaching the second inlet 7 connected to the main burner 1. In contrast, when the second pilot burner 37 is burning the first fuel (e.g., natural gas), the pilot flame of the second burner 20 will be shorter or smaller due to the lower thermal valve of the first fuel (as compared to the second fuel). As a result, the entire fifth thermocouple 21 will be at least slightly outside of the flame sensible area, such that the pilot flame of the second burner 20 will not be able to reach the fifth thermocouple 21. After the ignition button 35 is released, the second electromagnetic valve 64 will be maintained in an open position to permit fuel to reach the second inlet 7 connected to the main burner 1.

In one embodiment, the first thermocouple 15 of the first pilot burner 11 and the fourth thermocouple 22 of the second pilot burner 37 are operatively connected to the control valve 25 by electrical wiring or cable 34*a*, 34*b*. In that embodiment, thermoelectric potential generated by the first thermocouple 15 or the fourth thermocouple 22 can maintain the control valve 25 in the ON position when the control valve 25 is released by a user. If either the first thermocouple 15 or the fourth thermocouple 22 does not create sufficient thermoelectric potential, in this embodiment the control valve 25 would be moved to the OFF position.

The present invention is not limited to inclusion of the separate ignition button 35, as shown and described herein. Instead, in one embodiment, the control valve 25 can be movable (e.g., rotatable), as described above between an OFF position and an ON position, and depressible. For example, when the control valve 25 is pressed downward, the battery pack 36 can be engaged such that power is provided to both the first and second electromagnetic valves 38, 64. When the control valve 25 is released and permitted to return to an "up" position, power will be cut from the battery pack 36 to the first and second electromagnetic valves 38, 64.

Figure 14:
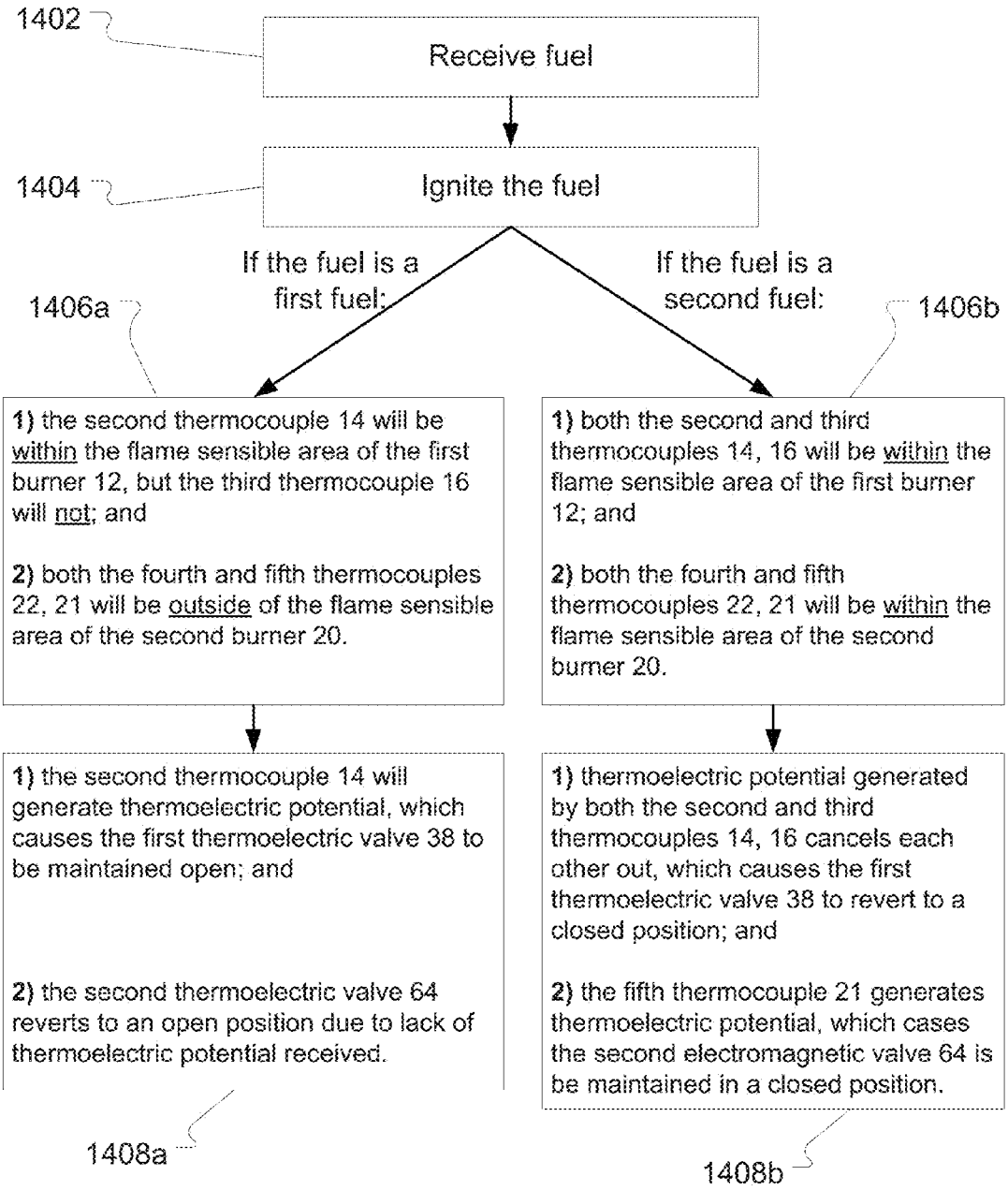
FIG. 14 is a flow diagram of one embodiment of a method of operating the heating system.

FIG. 14 shows one embodiment of a method of operating the heating system 100. The method can include receiving fuel (step 1402) and then igniting the fuel (step 1404). If the fuel is the first fuel, following ignition, thermoelectric potential is received from or produced by at least one of the thermocouples, such as the second thermocouple 14, of the first pilot burner 11 (step 1406*a*). This is because at least a portion of the second thermocouple 14 will be within the flame sensible area of the first burner 12. The first electromagnetic valve 38 is maintained in an open position in response to the thermoelectric potential received from the at least one thermocouple of the first pilot burner 11 (step 1408*a*). The second electromagnetic valve 64 is permitted to move to an open position based on the absence of thermoelectric potential received from any of the thermocouples, such as the fifth thermocouple 21, of the second pilot burner 37 (step 1408*a*). This is because the entire fifth thermocouple 21 will be outside of the flame sensible area of the second burner 20. As a result, the first fuel is thereby permitted to flow to both of the inlets 8, 7 of the main burner 1 and to both the first and second pilot burners 11, 37.

If the second fuel is provided to the heating system 100 instead of the first fuel, ignition of the second fuel (step 1404) causes thermoelectric potential to be created or produced from at least one of the thermocouples, such as the fifth thermocouple 21, of the second pilot burner 37 (step 1406*b*). This is because the entire fifth thermocouple 21 will be within the flame sensible area of the second burner 20. The second electromagnetic valve 64 is then maintained in a closed position based on the thermoelectric potential received from the thermocouples of the second pilot burner 37 (step 1408*b*). The first electromagnetic valve 38 is also to move to a closed position based on the absence or reduced amount of thermoelectric potential received from the thermocouple, such as the second thermocouple 14 of the first pilot burner 11 (step 1408*b*). This is because the entire second thermocouple 14 will be at least slightly outside of the flame sensible area of the first burner 12. As a result, the second fuel is prevented from flowing to the second inlet 7 of the main burner 1 and to the first pilot burner 11, but is permitted to flow to the first inlet 8 of the main burner 1 and to the second pilot burner 37.

The above-described components and processes allow the heating system 100 to utilize input received from one or more thermocouples to identify fuel type or source. The heating system 100 is able to automatically modify its configuration to account for the type of fuel being provided. Manual conversion of the heating system 100 is not required, as is common with prior art heating systems. As a result of these and other factors, the risk of malfunction is reduced and efficiency is increased.

Figure 15:
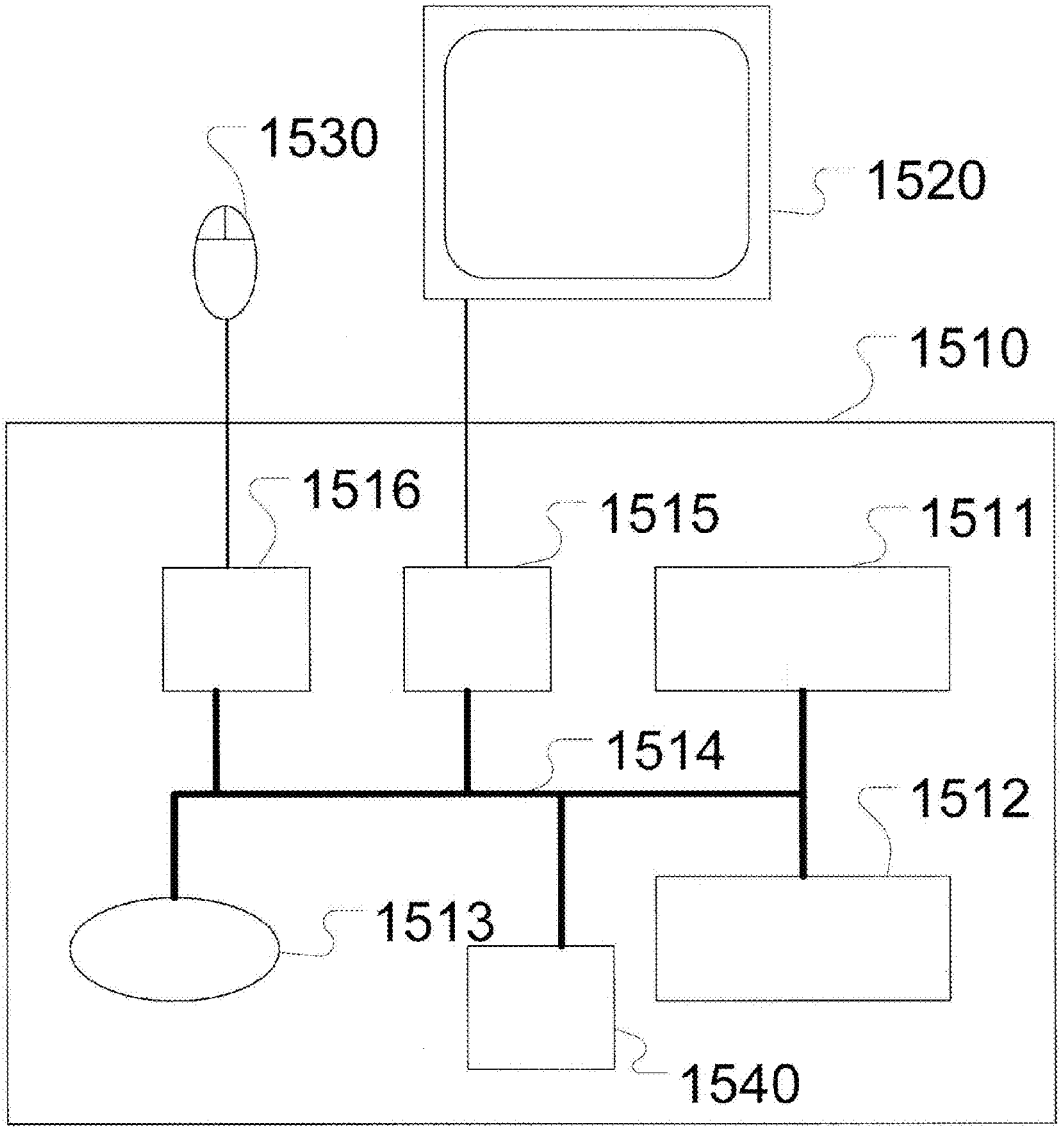
FIG. 15 shows an exemplary computing device useful for performing or initiating processes disclosed herein.
Figure 16:
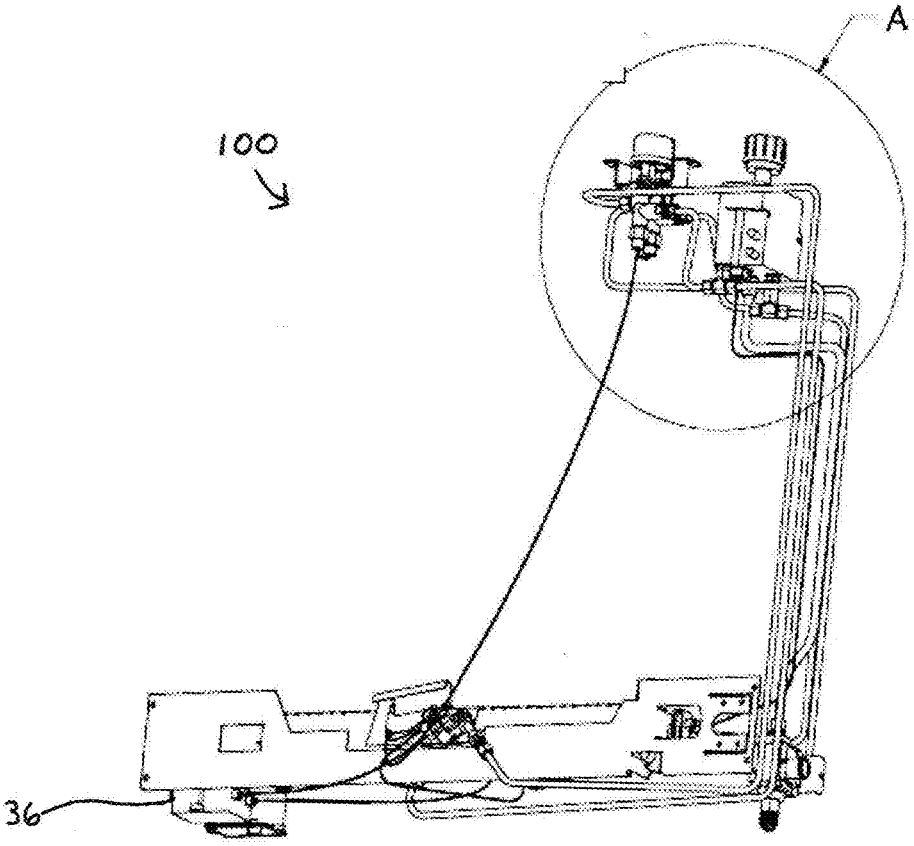
FIG. 16 is a perspective view of a heating system according to an embodiment of the present disclosure, wherein several components thereof are omitted for clarity.
Figure 17:
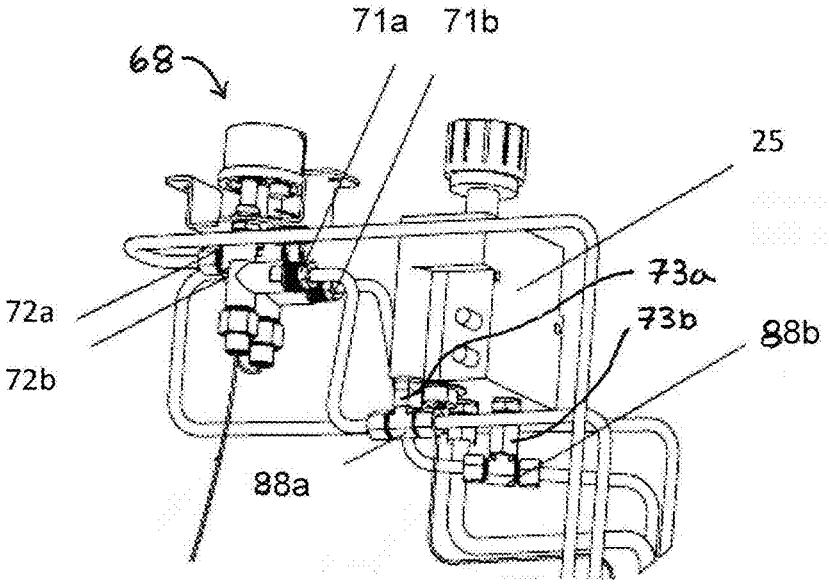
FIG. 17 is an enlarged perspective view of the portion of the heating system of FIG. 16 identified by area "A"
Figure 18:
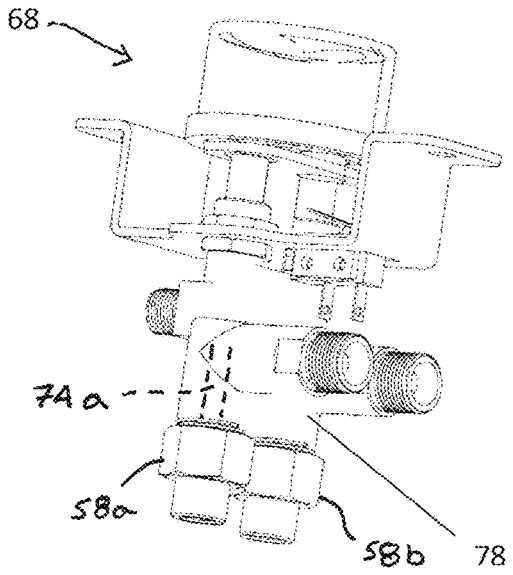
FIG. 18 is a perspective view of a valve of the heating system of FIG. 16.
Figure 19:
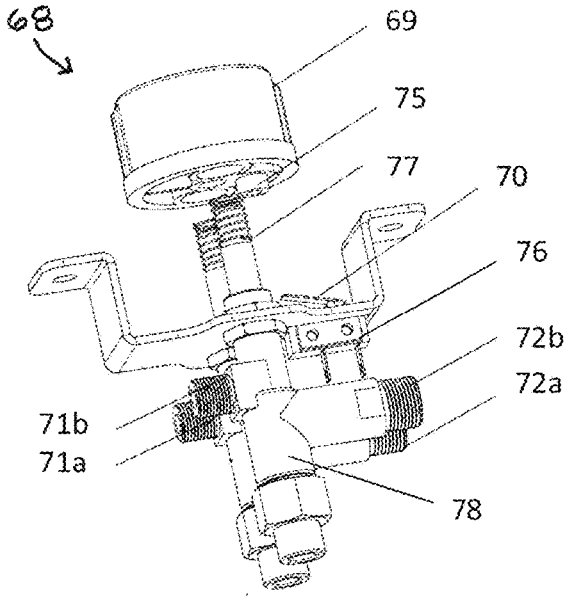
FIG. 19 is a partially exploded perspective view of the valve of FIG. 18.
Figure 20:
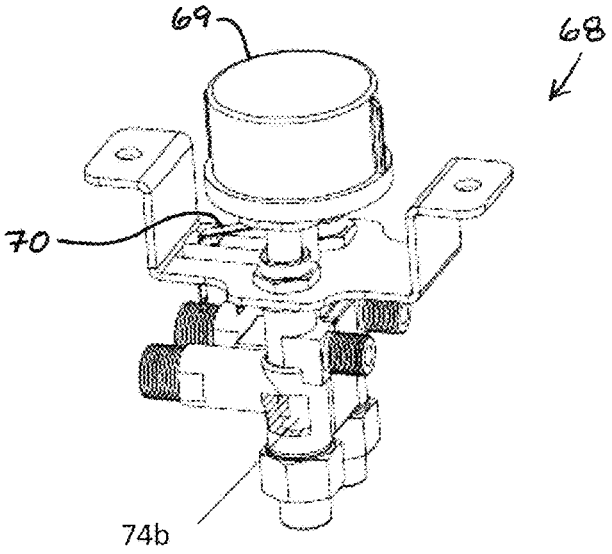
FIG. 20 is another perspective view of the valve of FIG. 18.
Figure 21:
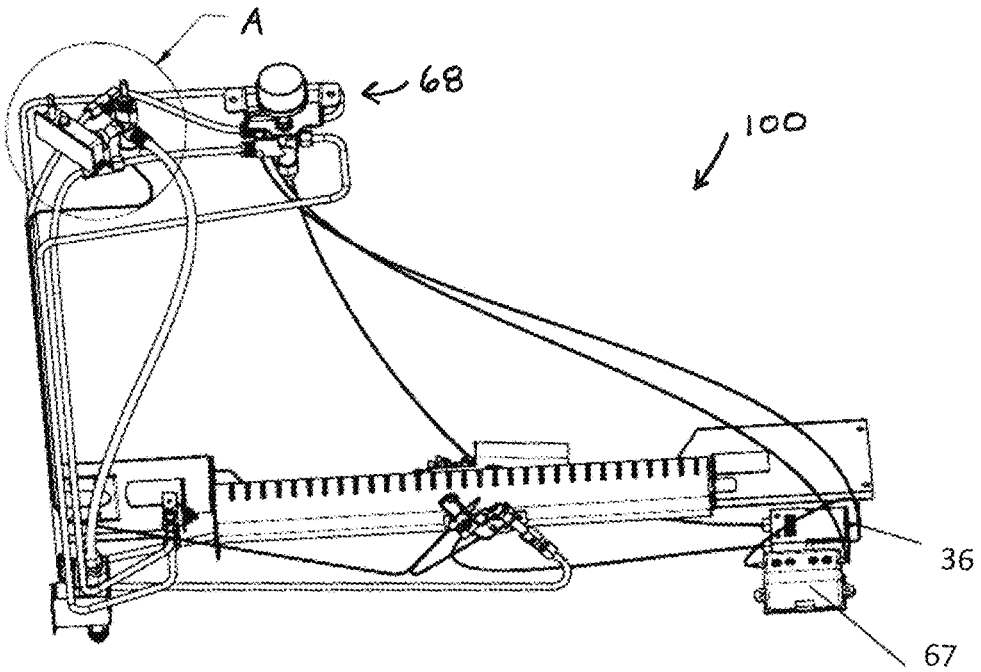
FIG. 21 is perspective view of the heating system of FIG. 16 with an alternative control panel.
Figure 22:
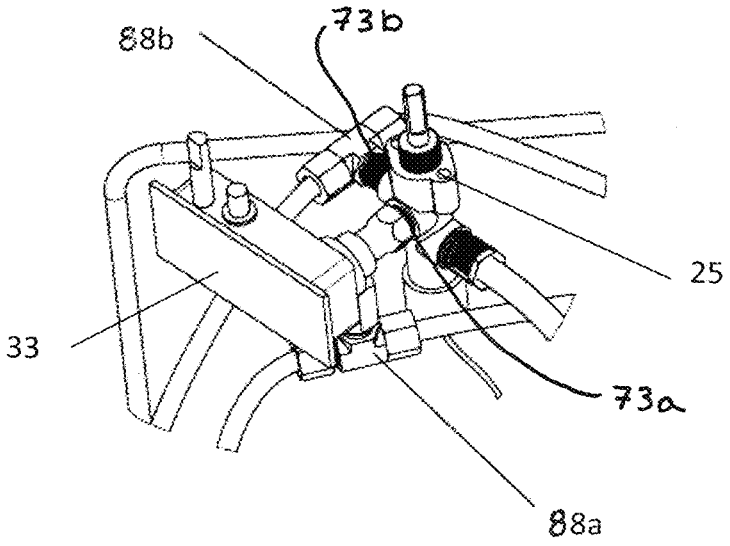
FIG. 22 is an enlarged perspective view of the portion of the heating system of FIG. 21 identified by area "A"
Figure 23A:
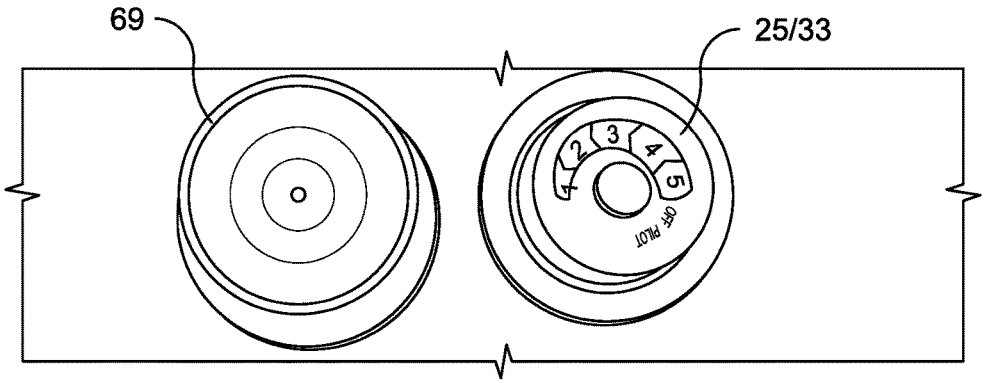
FIG. 23A is a top plan view of a control panel of the heating system of FIG. 16.
Figure 23B:
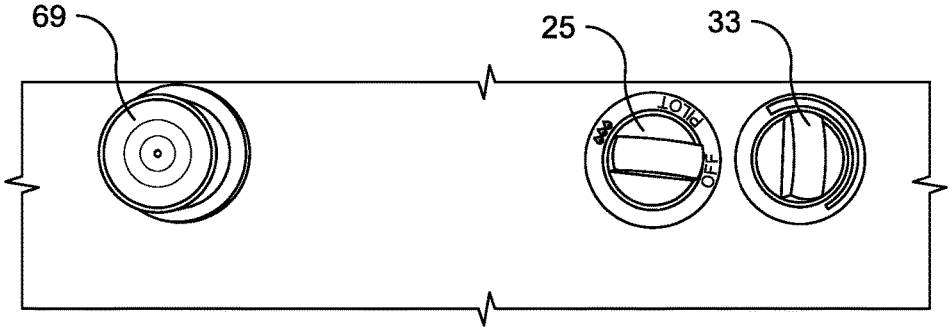
FIG. 23B is top plan view of the control panel of the heating system of FIG. 21.
Figure 24:
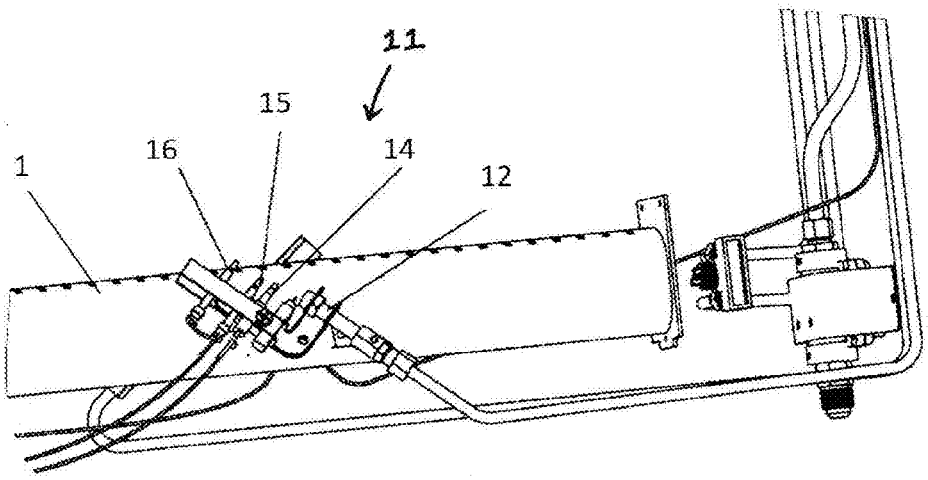
FIG. 24 is an enlarged perspective view of a portion of the heating system of FIGS. 16 and 21.
Figure 25:
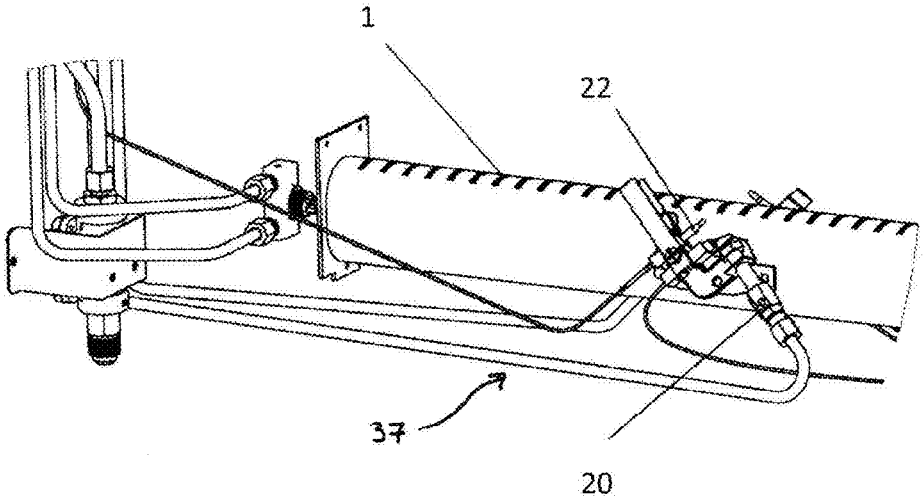
FIG. 25 is another enlarged perspective view of a portion of the heating system of FIGS. 16 and 21.

One or more of the above-described systems and/or methods may be implemented with or involve software, for example modules executed on or more computing devices 1510 (see FIG. 15). Of course, modules described herein illustrate various functionalities and do not limit the structure or functionality of any embodiments. Rather, the functionality of various modules may be divided differently and performed by more or fewer modules according to various design considerations.

Each computing device 1510 may include one or more processing devices 1511 designed to process instructions, for example computer readable instructions (i.e., code), stored in a non-transient manner on one or more storage devices 1513. By processing instructions, the processing device(s) 1511 can perform one or more of the steps and/or functions disclosed herein. Each processing device can be real or virtual. In a multi-processing system, multiple processing units can execute computer-executable instructions to increase processing power. The storage device(s) 1513 can be any type of non-transitory storage device (e.g., an optical storage device, a magnetic storage device, a solid state storage device, etc. The storage device(s) 1513 can be removable or non-removable, and include magnetic disks, magnetic tapes or cassettes, CD-ROMs, CD-RWs, DVDs, or any other medium which can be used to store information. Alternatively, instructions can be stored in one or more remote storage devices, for example storage devices accessed over a network or the internet.

Each computing device 1510 additionally can have memory 1512, one or more input controllers 1516, one or more output controllers 1515, and/or one or more communication connections 1540. The memory 1512 can be volatile memory (e.g., registers, cache, RAM, etc.), non-volatile memory (e.g., ROM, EEPROM, flash memory, etc.), or some combination thereof. In at least one embodiment, the memory 1512 can store software implementing described techniques.

An interconnection mechanism 1514, such as a bus, controller or network, can operatively couple components of the computing device 1510, including the processor(s) 1511, the memory 1512, the storage device(s) 1513, the input controller(s) 1516, the output controller(s) 1515, the communication connection(s) 1540, and any other devices (e.g., network controllers, sound controllers, etc.). The output controller(s) 1515 can be operatively coupled (e.g., via a wired or wireless connection) to one or more output devices 1520 (e.g., a monitor, a television, a mobile device screen, a touch-display, a printer, a speaker, etc.) in such a fashion that the output controller(s) 1515 can transform the display on the display device 1520 (e.g., in response to modules executed). The input controller(s) 1516 can be operatively coupled (e.g., via a wired or wireless connection) to an input device 1530 (e.g., a mouse, a keyboard, a touch-pad, a scroll-ball, a touch-display, a pen, a game controller, a voice input device, a scanning device, a digital camera, etc.) in such a fashion that input can be received from a user.

The communication connection(s) 1540 enable communication over a communication medium to another computing entity. The communication medium conveys information such as computer-executable instructions, audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

FIG. 15 illustrates the computing device 1510, the output device 1520, and the input device 1530 as separate devices for ease of identification only. However, the computing device 1510, the display device(s) 1520, and/or the input device(s) 1530 can be separate devices (e.g., a personal computer connected by wires to a monitor and mouse), can be integrated in a single device (e.g., a mobile device with a touch-display, such as a smartphone or a tablet), or any combination of devices (e.g., a computing device operatively coupled to a touch-screen display device, a plurality of computing devices attached to a single display device and input device, etc.). The computing device 1510 can be one or more servers, for example a farm of networked servers, a clustered server environment, or a cloud services running on remote computing devices.

FIGS. 16-28 show another embodiment of a heating system, generally designated 100, capable of automatically detecting when either a first fuel or a second fuel is supplied or received, and generating heat from the fuel. Stated simply, the heating system 100 is capable of such functionality following or upon engagement by a user of two controls. The heating system of the present embodiment is substantially similar to the heating system described in detail below. Therefore, the description of certain components and/or functions, either identical or substantially similar between the embodiments, may be omitted below for the sake of brevity and convenience only. Such omission is by no way limiting.

One distinguishing feature of the embodiment of FIGS. 16-28 is the use of a combined fuel distribution valve ("CFDV"), generally designated 68, instead of the first and second electromagnetic valves 38, 64 described in detail above. The CFDV 68 can be installed at or near a top of the heating system 100 and proximate to the control valve 25 and/or the thermostat 33. The control valve 25 is operatively connected to the first thermocouple 15 of the first pilot burner 11 and the fourth thermocouple 22 of the second pilot burner 37. In one version, the heating system 100 can include a combined control valve and thermostat 25/33 (see FIGS. 16, 17 and 23A), such that the thermostat is built into the control valve. In another version, the control valve 25 and the thermostat 33 separate, distinct and/or spaced-apart (see FIGS. 18, 19 and 23B).

The CFDV 68 can include a control knob 69 movable connected to a valve body 78. The valve body 78 having a first fluid channel 74*a* and a second fluid channel 74*b* spaced-part therefrom. An ignition switch 70 can be installed beneath the control knob 69 and can be operatively connected to the electrical power supply 36. The CFDV 68 can include first and second inlet interfaces 71*a*, 71*b* and first and second outlet interfaces 72*a*, 72*b*, which are fluidly connected by the first and second fluid channels 74*a*, 74*b*, respectively. The first and second inlet interfaces 71*a*, 71*b* are configured to receive fuel from first and second outlet interfaces 73*a*, 73*b*, respectively, of the control valve 25 through first and second T-joints 88*a*, 88*b*, respectively. The first and second outlet interfaces 72*a*, 72*b* are in fluid communication with the first burner 12 of the first pilot burner 11 and the main burner 1 through the second nozzle 5.

The CFDV 68 can also include a first electromagnetic valve 58*a* spaced-apart from a second electromagnetic valves 58*b*. The first and second electromagnetic valves 58*a*, 58*b* are attached and/or operatively connected to the first and second fluid channels 74*a*, 74*b*, respectively. More specifically, at least a portion of the first and second electromagnetic valves 58*a*, 58*b* can be attached to and/or located inside of the valve body 78 at an opposite end from the control knob 69. The first and second electromagnetic valves 58*a*, 58*b* can be operatively connected, via electrical wires, for example, to at least one of the thermocouples.

Figure 26C:
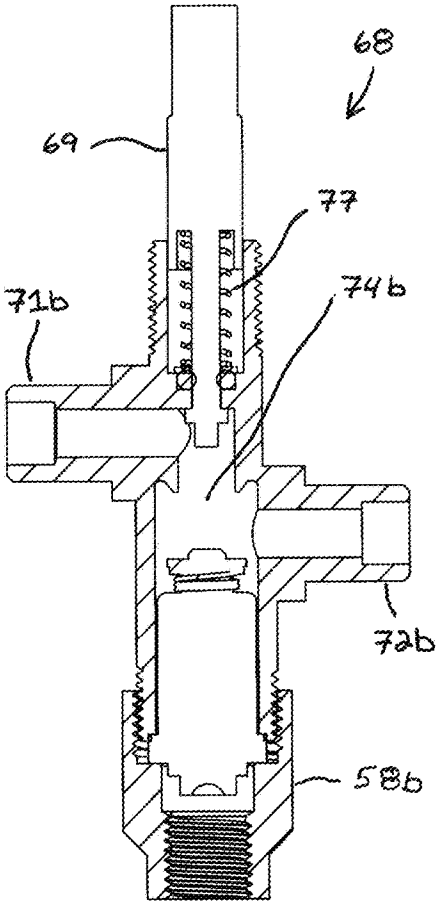
FIG. 26C is a cross-sectional elevation view of the valve of FIG. 23, wherein the valve is shown energized or controlled by at least one thermocouple to open the valve.
Figure 26B:
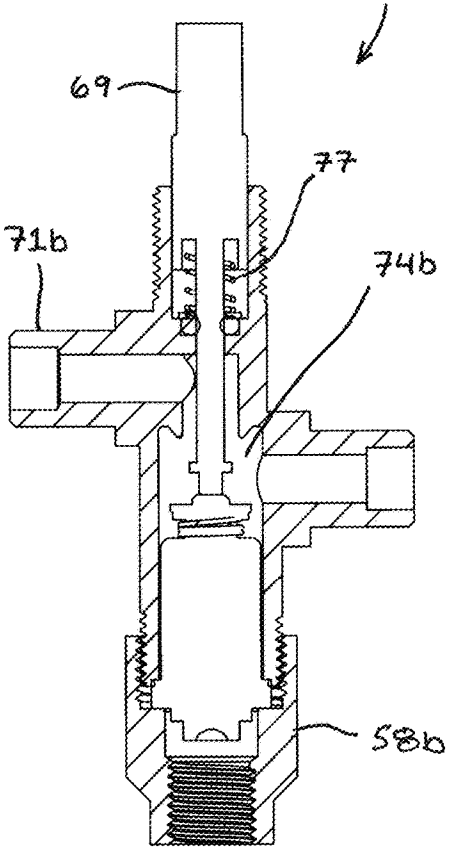
FIG. 26B is another cross-sectional elevation view of the valve of FIG. 23, wherein the valve is shown pushed inward or downward to open the valve.
Figure 26A:
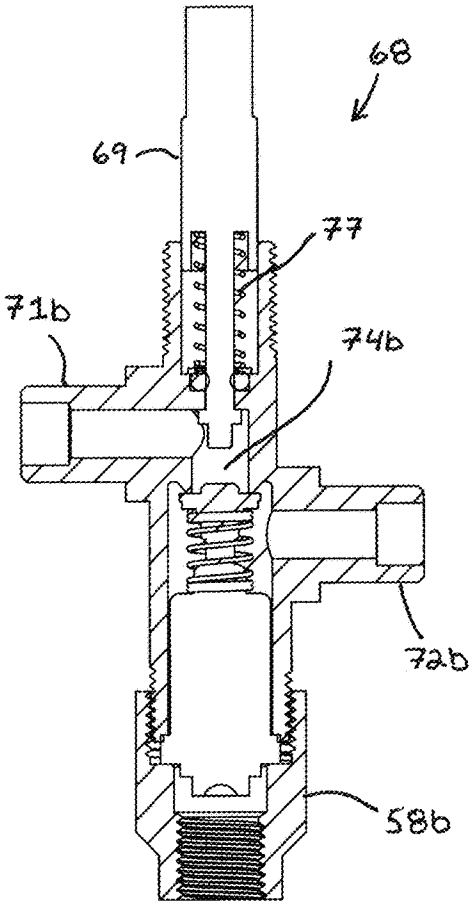
FIG. 26A is a cross-sectional elevation view of the valve of FIG. 23, wherein the valve is biased closed.

In one version, the CFDV 68 is biased to a closed position, such that the first and second gas channels 74*a*, 74*b* are closed (see FIGS. 26A-26C). In such a version, each of the first and second electromagnetic valves 58*a*, 58*b* are operatively connected to the second and third thermocouples 14, 16 of the first pilot burner 11. In addition, in this version, the first and second fluid channels 74*a*, 74*b* can be opened by either engaging or depressing the control knob 69 (see FIG. 26B) or by actuation of the first and second electromagnetic valves 58*a*, 58*b*, respectively (see FIG. 26C).

Figure 27C:
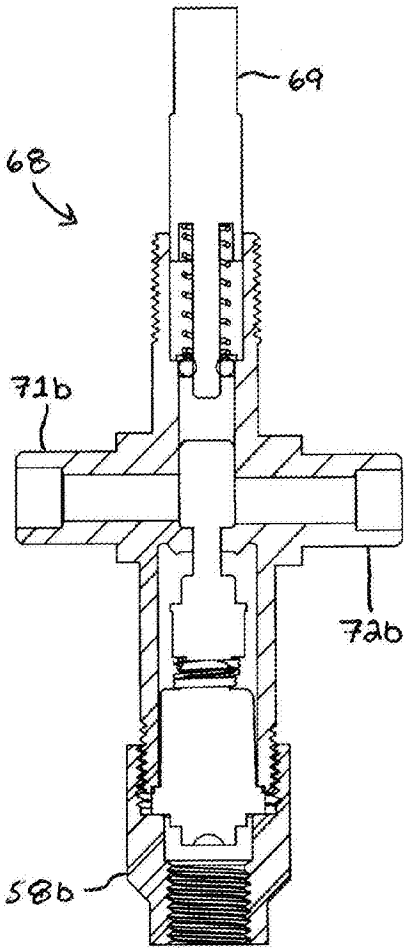
FIG. 27C is another cross-sectional elevation view of the valve of FIG. 23, wherein the valve is energized or controlled by at least one thermocouple to close the valve.
Figure 27B:
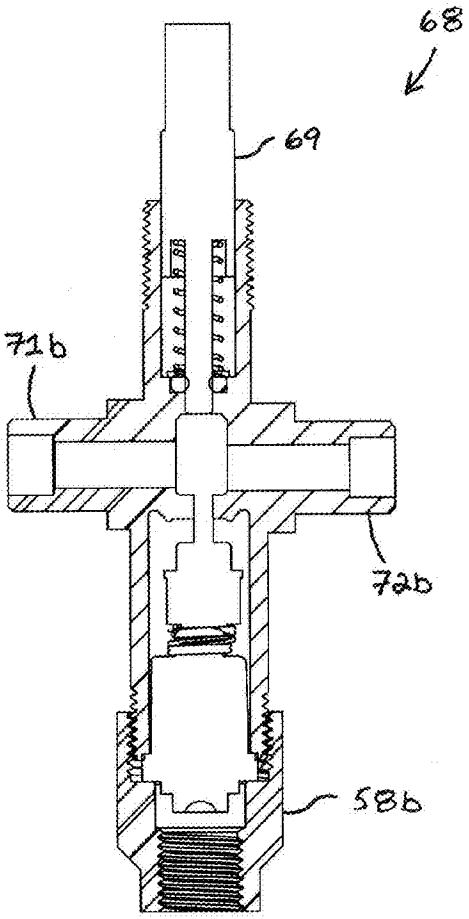
FIG. 27B is another cross-sectional elevation view of the valve of FIG. 23, wherein the valve is shown pushed inward or downward to close the valve.
Figure 27A:
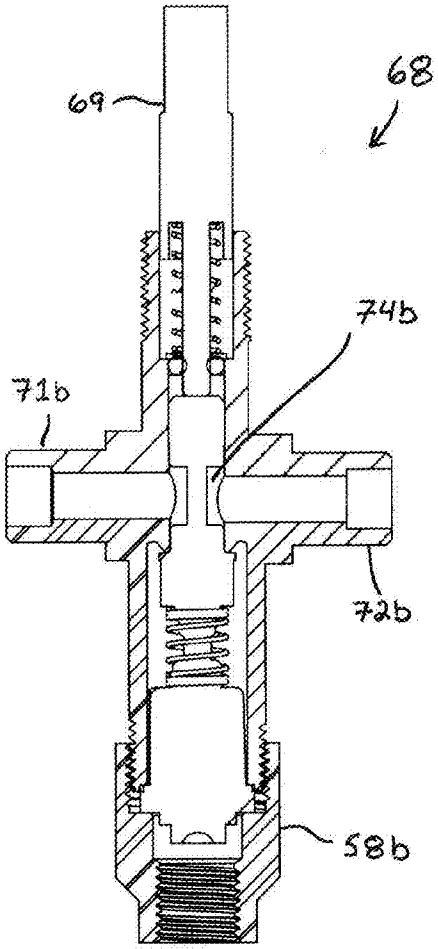
FIG. 27A is a cross-sectional elevation view of another embodiment of the valve of FIG. 23, wherein the valve is biased open.
Figure 28:
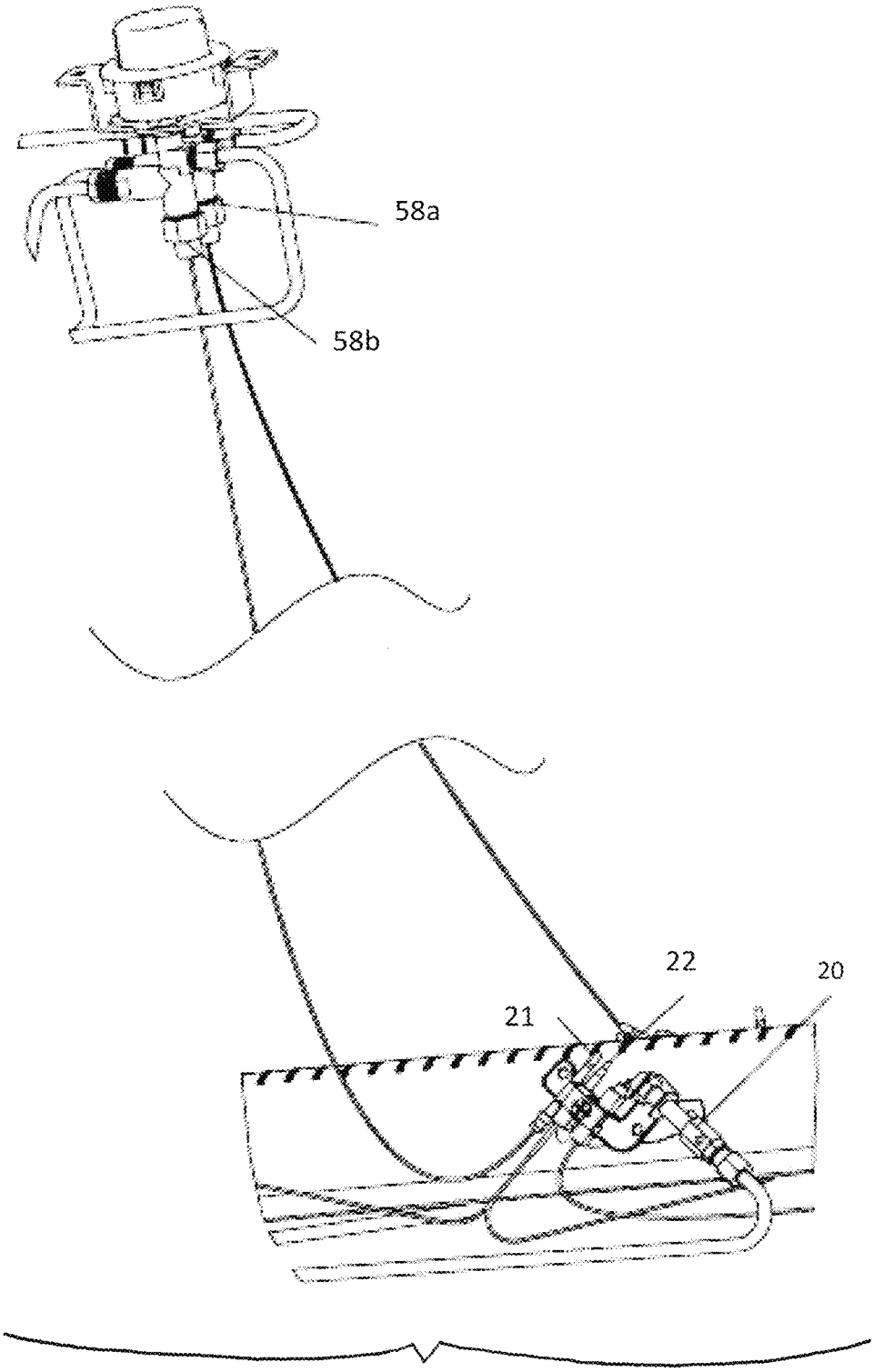
FIG. 28 is a perspective view portions of a heating system employing the valve of FIGS. 27A-27C.

In a second version, the CFDV 68 is biased to an open position, such that at least the second gas channel 74*b* is open (see FIGS. 27A-27C). In such a version, the first electromagnetic valve 58*a* is operatively connected to the second and third thermocouples 14, 16 of the first pilot burner 11, and the second electromagnetic valve 58*b* is operatively connected to the fifth thermocouple 21 of the second pilot burner 37 (see FIG. 28). In addition, in this version, the first and second fluid channels 74*a*, 74*b* can be closed by either engaging or depressing the control knob 69 (see FIG. 27B) or by actuation of the first and second electromagnetic valves 58*a*, 58*b*, respectively (see FIG. 27C).

In the embodiment in which the CFDV 68 is biased closed (see FIG. 26A-26C), the heating system 100 can be started or ignited by turning or rotating the control valve 25 to a PILOT or IGNITION position and then pressing downwardly on the control valve 25. As a result, fuel is transferred to the first T-joint 88*a* and then divided in the following two ways. First, some of the fuel flows to the second burner 20 of the second pilot burner 37. Second, some of the fuel flows to the first gas channel 74*a* of the CFDV 68.

At this point, if the control valve 25 is maintained in the depressed position and the control knob 69 of the CFDV 68 is also depressed at least a predetermined amount (thereby opening the CFDV 68), fuel will flow to the first burner 12 of the first pilot burner 11. Simultaneously, a contacting rod 75 (see FIG. 19) extending downwardly from a bottom of the control knob 69 will engage and/or depress an ignition switch 76 of the CFDV 68, which will cause sparks to be generated on both the second burner 20 of the second pilot burner 37 and the first burner 12 of the first pilot burner 11. At least one spring 77 can ensure that the CFDV 68 is fully or sufficiently pressed down before the ignition switch 76 is activated or turned "ON."

At ignition when burning the second fuel (e.g., liquid propane), the second burner 20 of the second pilot burner 37 will produce an average size flame. As a result, the fourth thermocouple 22, which will be within reach of the average size flame of the second burner 20, will generate thermoelectric potential to maintain the control valve 25 in an open position. Simultaneously, the first burner 12 of the first pilot burner 11 will produce a relatively large flame due, at least in part, to the larger orifice of the first burner 12. As a result, the flame produced by the first burner 12 will reach each of the first thermocouple 15, the second thermocouple 14 and the third thermocouple 16. Because the second thermocouple 14 is inversely connected to the third thermocouple 16, any combined thermoelectric potential transferred to the CFDV 68 will be negligible or zero, such that the first and second electromagnetic valves 58*a*, 58*b* will not be energized to maintain the CFDV 68 in the open. At this point, if or after the knob 69 of the CFDV 68 is released by the user, the first and second gas channels 74*a*, 74*b* of the CFDV 68 will be closed position and the flame of the first burner 12 of the first pilot burner 11 is immediately extinguished.

After ignition, when both the CFDV 68 and the control valve 25 are released by the user, the second burner 20 of the second pilot burner 37 continues to burn normally as the control valve 25 is in an open position and the CFDV 68 is closed. The control valve 25 can then be moved or rotated from the IGNITION position to the ON position, such that the fuel reaches the second T-joint 88*b* and is then divided in two ways. First, at least some of the fuel flows to the second gas channel 74*b* of the CFDV 68 and is stopped there because the second gas channel 74*b* is closed. Second, at least some of the fuel flows to the main burner 1 through the first nozzle 6.

At ignition when burning the first fuel (e.g., natural gas), the second burner 20 of the second pilot burner 37 will produce a relatively small flame due, at least in part, to the relatively small orifice of the second burner 20. However, the first burner 12 of the first pilot burner 11 will produce a relatively average size flame, which will reach the first thermocouple 15 and the second thermocouple 14. The third thermocouple 16 will be outside of the range of the flame produced by the first burner 12 and, therefore, will not and cannot generate inverse thermoelectric potential. As a result, thermoelectric potential generated by the second thermocouple 14 will maintain the control valve 25 in an open position, while the thermoelectric potential generated by the first thermocouple 15 will maintain the CFDV 68 in an open position.

After ignition, when both the CFDV 68 and the control valve 25 are released by the user, the first burner 12 of the first pilot burner 11 continues to burn with the average size flame and the second burner 20 of the second pilot burner 37 continues to burn with the relatively small flame. As a result, both the CFDV 68 and the control valve 25 are maintained in an open position. When the control valve 25 is moved or rotated from the IGNITION position to the ON position, fuel reaches the second T-joint 88*b* and then is divided in two ways. First, at least some of the fuel flows to the second gas channel 74*b* of the CFDV 68 and eventually reaches the main burner 1 through the second nozzle 5. Second, at least some of the fuel reaches the main burner 1 through the first nozzle 6. The first and second nozzles 6, 5 can be designed such that the first nozzle 6 will match or achieve the designed heat input when burning the second fuel (e.g., liquid propane) and the second nozzle 5 supplements the first nozzle 6 by helping to match or achieve the designed heat input when burning the first fuel (e.g., natural gas).

At ignition in the embodiment in which the CFDV 68 is biased open (see FIG. 27A-27C), the user can depress the control knob 69 to thereby open the first gas channel 74*a* and close the second gas channel 74*b*. As a result, fuel flow in the first gas channel 74*a* is the same as described above, while fuel flow in the second gas channel 74*b* is different. When burning the second fuel (e.g., liquid propane), the second burner 20 of the second pilot burner 37 produces an average size flame and thermoelectric potential generated by the fifth thermocouple 21 of the second pilot burner 37 energizes the second electromagnetic valve 58*b* to maintain the second fluid channel 74*b* in a closed position even if the control knob 69 is released. As a result, fuel cannot reach the main burner 1 through the second nozzle 5.

When burning the first fuel (e.g., natural gas), the second burner 20 of the second pilot burner 37 produces a relatively small flame, which is unable to reach the fifth thermocouple 21 of the second pilot burner 37. As a result, the fifth thermocouple 21 does not generate sufficient thermoelectric potential to energize the second electromagnetic valve 58*b*, which will allow the second fluid channel 74*b* to move to an open position once the control knob 69 is released by the user. As a result, fuel flows to the main burner 1 through the second nozzle 5, as well as through the first nozzle 6.

It will be appreciated by those skilled in the art that changes could be made to the embodiments described above without departing from the broad inventive concept thereof. For example, the steps or order of operation of the above-described method could be rearranged or occur in a different series, as understood by those skilled in the art. It is understood, therefore, that this disclosure is not limited to the particular embodiments disclosed, but it is intended to cover modifications within the spirit and scope of the present disclosure as defined by the appended claims.

I claim:

1. A heating system capable of generating heat when supplied with either a first fuel or a second fuel, the system comprising:

at least one main burner configured to generate heat, the at least one main burner receiving the fuel through at least one of a first inlet and a second inlet;

a first pilot burner including at least one thermocouple;

a second pilot burner including at least one thermocouple;

a supply piping assembly configured to supply either the first fuel or the second fuel to the at least one main burner, the first pilot burner and the second pilot burner;

an electrical power supply; and first and second electromagnetic valves each operatively connected to the electrical power supply and at least one of the thermocouples, the first and second electromagnetic valves being configured to permit and prevent the fuel from reaching at least one of the first pilot burner, the second pilot burner and the at least one main burner depending upon thermoelectric potential received from the at least one of the thermocouples, wherein:

the first electromagnetic valve is operatively connected to the at least one thermocouple of the first pilot burner, the first electromagnetic valve being configured to permit or prevent the fuel from reaching the first pilot burner depending upon thermoelectric potential received from the at least one thermocouple of the first pilot burner; and the second electromagnetic valve is operatively connected to the at least one thermocouple of the second pilot burner, the second electromagnetic valve being configured to permit and prevent the fuel from reaching the second inlet depending upon thermoelectric potential received from the at least one thermocouple of the second pilot burner.

2. The heating system of claim 1, wherein the first electromagnetic valve is biased to a closed position and a position of the first electromagnetic valve depends upon the thermoelectric potential received from the at least one thermocouple of the first pilot burner, and wherein the second electromagnetic valve is biased to an open position and a position of the second electromagnetic valve depends upon the thermoelectric potential received from the at least one thermocouple of the second pilot burner.

3. The heating system of claim 2, wherein the first electromagnetic valve is maintained in an open position when the first fuel is supplied by the supply piping assembly.

4. The heating system of claim 3, wherein the first electromagnetic valve is moved to the closed position when the second fuel is supplied by the supply piping assembly.

5. The heating system of claim 1, wherein the first fuel is natural gas and the second fuel is liquid propane.

6. The heating system of claim 1, wherein the second fuel has a greater heating value than the first fuel.

7. The heating system of claim 1, further comprising:

a main burner pipe including a first joint, the main burner pipe connecting the supply piping assembly to the first and second inlets of the at least one main burner; and a pilot burner pipe including a second joint, the pilot burner pipe operatively connecting the supply piping assembly with the first and second pilot burners.

8. The heating system of claim 7, wherein the first electromagnetic valve is positioned in the pilot burner pipe between the second joint and the first pilot burner; and wherein the second electromagnetic valve is positioned in the main burner pipe between the first joint and the second inlet of the at least one main burner.

9. The heating system of claim 1, wherein the first pilot burner includes a first burner and a first ignition electrode, and wherein the at least one thermocouple of the first pilot burner includes a first thermocouple, a second thermocouple and a third thermocouple.

10. The heating system of claim 9, wherein the second pilot burner includes a second burner and a second ignition electrode, and wherein the at least one thermocouple of the second pilot burner includes a fourth thermocouple and a fifth thermocouple.

11. The heating system of claim 10, wherein a diameter of an orifice of the first burner is larger than a diameter of an orifice of the second burner.

12. The heating system of claim 11, wherein when the second burner burns the first fuel, a flame produced by the second burner cannot reach either the fourth thermocouple or the fifth thermocouple of the second pilot burner.

13. The heating system of claim 1, further comprising:

a control valve movable between at least an OFF position and an ON position, in the OFF position the fuel being prevented from reaching the at least one main burner, the first pilot burner and the second pilot burner, the control valve being operatively connected to at least the at least one thermocouple of the first pilot burner and to the at least one thermocouple of the second pilot burner.

14. The heating system of claim 1, wherein the electrical power supply is a battery.

15. The heating system of claim 1, further comprising:

one or more processors; and one or more memories operatively coupled to the one or more processors and having computer readable instructions stored thereon which, when executed by at least one of the one or more processors, causes the at least one of the one or more processors to:

permit or prevent the fuel from reaching the first pilot burner depending upon thermoelectric potential received from the at least one thermocouple of the first pilot burner; and permit or prevent the fuel from reaching the second inlet depending upon thermoelectric potential received from the at least one thermocouple of the second pilot burner.

16. The heating system of claim 1, further comprising:

a fuel distribution valve including a control knob movably connected to a valve body, the valve body having a first fluid channel and a second fluid channel spaced-apart therefrom, the first electromagnetic valve being operatively connected to the first fluid channel and the second electromagnetic valve being operatively connected to the second fluid channel, the first and second electromagnetic valves being attached to the valve body at an end opposite to the control knob.

17. The heating system of claim 16, wherein the fuel distribution valve is biased to a closed position, and wherein the fuel distribution valve is configured to be opened by either moving the control knob or providing thermoelectric potential to the first and second electromagnetic valves.

18. The heating system of claim 16, wherein the fuel distribution valve is biased to an open position, and wherein the fuel distribution valve is configured to be closed by either moving the control knob or providing thermoelectric potential to the first and second electromagnetic valves.

19. A method of operating a heating system, the method comprising:

receiving a first fuel;

igniting the first fuel;

receiving thermoelectric potential from a first thermocouple in response to the first fuel being ignited;

causing a first electromagnetic valve to be maintained in an open position in response to the thermoelectric potential received from the first thermocouple;

allowing a second electromagnetic valve to move to an open position based on the absence of thermoelectric potential received from a second thermocouple;

receiving a second fuel;

igniting the second fuel;

receiving thermoelectric potential from the second thermocouple in response to the second fuel being ignited;

causing the second electromagnetic valve to be maintained in a closed position based on the thermoelectric potential received from the second thermocouple; and allowing the first electromagnetic valve to move to a closed position based on the absence of thermoelectric potential received from the first thermocouple.

20. The method of claim 19, wherein the second fuel has a greater heating value than the first fuel.

21. The method of claim 20, wherein the first electromagnetic valve is biased to the closed position and the second electromagnetic valve is biased to the open position.

22. The method of claim 19, wherein the first fuel is permitted to flow to two inlets of at least one main burner and to both a first pilot burner and a second pilot burner.

23. The method of claim 22, wherein the second fuel is prevented from flowing to one of the two inlets of the at least one main burner and to the first pilot burner.

24. The method of claim 19, wherein a non-transitory computer-readable medium having computer-readable code stored thereon that, when executed by one or more computing devices, causes the one or more computing devices to:

maintain the first electromagnetic valve in the open position in response to the thermoelectric potential received from the first thermocouple; and moving the second electromagnetic valve to move to the open position based on the absence of thermoelectric potential received from a second thermocouple.

* * * * *